US010947845B2

(12) United States Patent
Jordaan et al.

(10) Patent No.: US 10,947,845 B2
(45) Date of Patent: Mar. 16, 2021

(54) SHAFT ENLARGEMENT ARRANGEMENT FOR A BORING SYSTEM

(71) Applicant: MASTER SINKERS (PTY) LTD, Fochville (ZA)

(72) Inventors: Barend Jacobus Jordaan, Johannesburg (ZA); Nicolaas Bodenstein Goodwin, Fochville (ZA); Daniel Coenraad Pretorius, Fochville (ZA); Louis Germishuys, Centurion (ZA); Gerhard Pretorius, Fochville (ZA)

(73) Assignee: MASTER SINKERS (PTY) LTD, Fochville (ZA)

( * ) Notice: Subject to any disclaimer, the term of this patent is extended or adjusted under 35 U.S.C. 154(b) by 0 days.

(21) Appl. No.: 16/335,502

(22) PCT Filed: Sep. 21, 2017

(86) PCT No.: PCT/IB2017/055734
§ 371 (c)(1),
(2) Date: Mar. 21, 2019

(87) PCT Pub. No.: WO2018/055549
PCT Pub. Date: Mar. 29, 2018

(65) Prior Publication Data

US 2020/0018163 A1 Jan. 16, 2020

(30) Foreign Application Priority Data

Sep. 21, 2016 (ZA) ..... 2016/06512

(51) Int. Cl.
*E21D 1/06* (2006.01)
*E21B 7/28* (2006.01)
*E21B 10/28* (2006.01)

(52) U.S. Cl.
CPC ..... *E21D 1/06* (2013.01); *E21B 7/28* (2013.01); *E21B 10/28* (2013.01)

(58) Field of Classification Search
CPC . E21B 7/28; E21B 10/28; E21B 10/26; E21D 1/06
See application file for complete search history.

(56) References Cited

U.S. PATENT DOCUMENTS 3,379,264 A 4/1968 Cox
3,485,309 A 12/1969 Lawrence
(Continued)

FOREIGN PATENT DOCUMENTS

EP 0050954 A1 5/1982
WO 2016/116910 A1 7/2016

OTHER PUBLICATIONS

International Search Report and Written Opiinion for PCT/IB2017/055734 dated Nov. 21, 2017, pp. 1-9.
(Continued)

*Primary Examiner* — David J Bagnell
*Assistant Examiner* — Yanick A Akaragwe
(74) *Attorney, Agent, or Firm* — McCarter & English, LLP; David R. Burns

(57) ABSTRACT

A shaft enlargement arrangement for a boring system comprises a hollow column proximate a lower end of the boring system. A reamer section comprising a downwardly tapering first cutter head arrangement is rotatably fitted to the hollow column, with a first drive being provided to rotate the first cutter head arrangement relative to the hollow column so as to bore downwardly a hole having a diameter corresponding substantially to the diameter of the first cutter head arrangement. A boring head arrangement is fitted to an operatively lower end, the boring head arrangement terminating in a downwardly tapering second cutter head arrangement to
(Continued)

bore a leading or pilot hole, having a diameter that is less than the diameter of the first cutter head arrangement, as the boring system proceeds to bore downwardly.

20 Claims, 25 Drawing Sheets

(56) References Cited

U.S. PATENT DOCUMENTS

| | | | | |
|---|---|---|---|---|
| 3,934,660 | A | 1/1976 | Nelson | |
| 3,965,995 | A * | 6/1976 | Sugden | E21D 1/03 175/57 |
| 4,274,675 | A | 6/1981 | Paurat et al. | |
| 4,589,502 | A * | 5/1986 | Salter | E21B 7/003 175/102 |
| 4,732,226 | A * | 3/1988 | Ebeling | E21B 4/16 175/102 |
| 2012/0318581 | A1* | 12/2012 | Webb | E21D 1/06 175/57 |
| 2016/0040482 | A1* | 2/2016 | Loikkanen | E21B 10/25 175/371 |
| 2018/0010392 | A1 | 1/2018 | Kleuters et al. | |

OTHER PUBLICATIONS

International Search Report and Written Opinion for Application No. PCT/IB2016/050357, dated Apr. 1, 2016. 9 pages.

* cited by examiner

SHAFT ENLARGEMENT ARRANGEMENT FOR A BORING SYSTEM

RELATED APPLICATIONS

This application is a 35 U.S.C. § 371 national stage filing of International Application No. PCT/IB2017/055734, filed on Sep. 21, 2017, which claims priority to South African Patent Application No. 2016/06512, filed on Sep. 21, 2016. The entire contents of each of the foregoing applications are incorporated herein by reference.

FIELD OF THE INVENTION

This invention relates to a boring system (or rig or machine), and in particular, in one version, to a blind shaft boring system. In broad terms, the boring system comprises an aboveground support rig arrangement, and an underground shaft enlargement arrangement. The boring system may be used to bore substantially vertical holes or shafts by initiating rock boring at ground level and boring a predetermined distance vertically downwardly, without the need for a presink as is often required with blind hole boring systems.

BACKGROUND TO THE INVENTION

Conventional raise boring begins with the drilling of a pilot hole vertically down, typically using a directional drilling system. It is drilled using a drilling unit at the surface from which a hollow drill string, comprising a plurality of drill pipes fitted together, extends downwardly. A roller bit to drill the pilot hole is fitted to the lowermost drill pipe of the drill string, with the pipes having a standard thread for high-torque applications. After the pilot hole has broken through to a lower level, the roller bit is removed and replaced with a reamer head comprising a plurality of cutters. The reamer head is rotated and pulled back towards the surface-mounted drilling unit so as to cut a larger hole, or raise, through the ground and rock. The cuttings fall by gravity into a chamber at the bottom of the hole, typically in an uncontrolled manner, where they are removed using a loader.

Blind hole boring, on the other hand, comprises drilling an oversized pilot hole. The oversized pilot hole can be drilled either in a single step, or, more typically, by first drilling an initial 400 mm pilot hole, for example, which is then subsequently enlarged to define a 3*m* oversized pilot hole. This process is reasonably well known in the art. A cutting head is then installed above the drilled oversized pilot hole, so that drilling can occur downwardly. The cuttings are then flushed out of the oversized pilot hole. This particular technique is not used that often, as the risk of blocking the pilot hole and creating mud rushes at the bottom of the hole is relatively high.

No known boring system is capable of boring relatively larger holes (preferably having a diameter of between 6 and 9.5 metres), with the cuttings being removable from above the boring system without having to flush out the cuttings, using, for example, reverse circulation.

It is an aim of the present invention to provide a boring system or rig to achieve the above objectives, in an efficient and versatile manner, and without having to drill an initial pilot hole, as is conventionally done.

SUMMARY OF THE INVENTION

According to the invention there is provided a shaft enlargement arrangement for a boring system, the shaft enlargement arrangement comprising:

- a hollow column proximate a lower end of the boring system;
- a reamer section comprising a downwardly tapering first cutter head arrangement that is rotatably fitted to the hollow column, with first drive means being provided to rotate the first cutter head arrangement relative to the hollow column so as to bore downwardly a hole having a diameter corresponding substantially to the diameter of the first cutter head arrangement;
- a boring head arrangement fitted to an operatively lower end, the boring head arrangement terminating in a downwardly tapering second cutter head arrangement to bore a leading or pilot hole, having a diameter that is less than the diameter of the first cutter head arrangement, as the boring system proceeds to bore downwardly;
- a thrust section to allow the boring head arrangement to advance relative to the reamer section; and
- a gripper arrangement to secure the shaft enlargement arrangement within the bored hole and to control the advancing of the boring head arrangement relative to the reamer section.

In an embodiment, the first cutter head arrangement comprises a support body carrying a first winged arrangement, the support body being rotatably fitted around the column, the first winged arrangement comprising a plurality of wings fitted to the support body, each wing having an angled or transversely extending, typically at 45 degrees, support beam to which is fitted, or which comprises, a plurality of first cutter elements. The angled support beams are arranged to define a substantially V-shaped cutting profile.

In an embodiment, a gearing housing is mounted above the first cutter head arrangement and around the column, with the first drive means being fitted atop the gearing housing and arranged to drive a gearing arrangement within the gearing housing, which in turn is arranged to rotate the support body and first cutter head arrangement around the column. Typically, the first drive means comprises a plurality of electric motors arranged around the periphery of the gearing housing.

In an embodiment, each wing is removably fitted or fittable to the support body, so that wings of different sizes may be interchanged, to enable holes of varying diameters to be bored.

In an embodiment, at least one collecting channel is defined in the hollow column, below the first cutter head arrangement, into which cuttings produced by the rotating first cutter head arrangement can be collected. The collecting channel defines an inlet to receive the cuttings, an outlet through which the cuttings can exit the channel into the column, with a downwardly angled passageway being provided between the inlet and outlet to facilitate the passage of cuttings into the column under the influence of gravity, for subsequent collection by a kibble travelling up and down the column.

Typically, the shaft enlargement arrangement includes a pair of diametrically opposed collecting channels, with the lowermost portions of the winged arrangement including scrapers to scrape the cuttings into the collecting channels as the first cutter head arrangement rotates relative to the column.

In an embodiment, the gripper arrangement is fitted to the hollow column, the gripper arrangement including a first series of circumferentially spaced gripper pads located between the first cutter head arrangement and the thrust section, and a second series of circumferentially spaced gripper pads located between the thrust section and the second cutter head arrangement. The gripper arrangement is arranged to securely grip against the leading hole bored by the second cutter head arrangement, so as to secure the boring system in position within the bored hole, control the advancing of the boring head arrangement relative to the reamer section and to facilitate and/or control rotation of the first cutter head arrangement.

In an embodiment, the first and second series of gripper pads extend sidewardly away from the hollow column, through an outer shield, and are movable, by means of first and second actuator arrangements, respectively, between a retracted, disengaged position and an extended, engaged position in which the pads clamp against the leading hole defined by the second cutter head arrangement.

In an embodiment, within the thrust section, a third actuator arrangement is provided to allow the boring head arrangement to advance relative to the reamer section.

In an embodiment, the second cutter head arrangement comprises a support body carrying a second winged arrangement, the support body being rotatable relative to a support housing from which it extends.

The second winged arrangement comprises a plurality of wings fitted to the support body, each wing having an angled or transversely extending, typically at 45 degrees, wing arm to which is fitted, or which comprises, a plurality of second cutter elements. The angled wing arms are arranged to define a substantially V-shaped cutting profile.

In an embodiment, second drive means are fitted atop the support housing and arranged to drive a gearing arrangement within the support housing, which in turn is arranged to rotate the support body and second cutter head arrangement. Typically, the second drive means comprises a plurality of electric motors arranged around the periphery of the support housing.

In an embodiment, a shield surrounds the support housing and second drive means, with the support housing and/or second drive means being secured to the end of the hollow column.

In an embodiment, fourth actuator means are provide to move the wings relative to the support body, between an extended, operational V-shaped configuration, to facilitate boring, and a collapsed, substantially aligned (typically parallel) configuration, to enable the second cutter head arrangement to be detached from the rest of the shaft enlargement arrangement and pulled up through the hollow column to surface. The diameter of the collapsed second cutter head arrangement, which corresponds substantially to the diameter of the support housing, is thus less than the diameter of the hollow column, to facilitate this removal.

In an alternate, preferred embodiment, the boring head arrangement comprises a frusto-conical slurry boring head having a slurry pump, the slurry boring head comprising a tapering side wall terminating in an end face, the tapering side wall and/or the end face being fitted with the second cutter head arrangement to bore the leading hole as the boring system progresses downwardly. In this embodiment, the second cutter head arrangement may be fitted with, or include, a plurality of second cutter elements.

In an embodiment, the boring head arrangement comprises a support housing with the slurry boring head being rotatable relative to the support housing, wherein second drive means is fitted atop the support housing and arranged to drive a gearing arrangement within the support housing, which in turn is arranged to rotate the slurry boring head relative to the support housing.

In an embodiment, a section of the slurry boring head can be separated and removed from the slurry boring head, the removable section including at least the end face and the slurry pump.

In an embodiment, each of the second cutter elements comprises a working face from which a plurality of rows of buttons extend. The rows of buttons are spaced approximately 25 mm apart, which ensures that the rock chips produced by the interaction between the buttons and the cutting face is approximately 25 mm. In addition, the working face of the cutter element is spaced approximately 50 mm away from the cutting face.

In an embodiment, the boring system includes a plurality of support decks locatable above the shaft enlargement arrangement, within the hole bored by the first cutter head arrangement, with the shaft enlargement arrangement being separable from the plurality of support decks.

The boring system further includes an aboveground support rig arrangement comprising an overhead support assembly and a headgear arrangement to lift and lower the shaft enlargement arrangement and the plurality of support decks.

In an embodiment, a mobile service deck is provided above the plurality of support decks, to which a spreader bar is connected or connectable, wherein the mobile service deck can be lifted, separated and temporarily accommodated between the headgear arrangement, to enable the spreader bar to be used to fetch a component or item within the shaft and hoist it to surface.

In an embodiment, to enable a level extending away from the shaft to be formed, the shaft enlargement arrangement can be fully disconnected (or decoupled) from the rest of the boring system, with a cover being provided to cover the portion of the shaft immediately above the disconnected shaft enlargement arrangement. The plurality of support decks may then be lifted away from the disconnected shaft enlargement arrangement to provide sufficient space for the formation of the breakaway level. Using explosives or suitable equipment, the breakaway may be formed, and once formed, the cover may be removed, and the shaft enlargement arrangement may be reconnected to the rest of the boring system to enable the shaft enlargement arrangement to continue operating.

In an embodiment, one of the support decks comprises a hoisting arrangement.

In one version, the hoisting arrangement comprises a pump and a sieve bend, with the sieve bend receiving slurry water pumped up through pipeline by means of a slurry pump proximate the slurry cutting head. The slurry water is separated with the more solid components/muck being discharged into the kibble via a retractable chute. The separated dirty water is then pumped with the triplex pump through pipeline where the fines will be removed from the water. Clean water may then be pumped back to the system.

In another version, the hoisting arrangement comprises a vacuum system to suck dry muck and cuttings into a vacuum tank, with the vacuum tank then discharging the dry material via a retractable chute into the kibble, which may then be hoisted up to surface. This arrangement is particularly useful in ground conditions where no water can be used, such as salt mines.

In yet another version, the hoisting arrangement comprises a high pressure water pipe to pump water from surface into the system, a low pressure surplus water pipe to allow surplus water to flow back to a sump, a high pressure water pipe which contains particles to be hoisted to surface, a low pressure incoming water pipe with particles, and a multi-chamber arrangement with valves to regulate and control the flow of water through the water pipes.

In an embodiment, the boring system comprises a pipe handling arrangement, the pipe handling arrangement comprising an overhead rig to raise and lower at least one pipe, and a guide means comprising a plurality of rotatable rollers that define a curved recess for accommodating an outer rounded portion of the pipe, so that as the pipes are raised and lowered, a pair of adjacent rollers accommodate the pipe to guide the movement of the pipe therebetween.

BRIEF DESCRIPTION OF THE DRAWINGS

These and other features of the present invention will be evident when considered in light of the following specification and drawings in which:

FIGS. 17 and 18A to 181 show the relative positioning of a mobile service deck and spreader bar relative to an overhead support assembly, to enable items to be easily removed from the shaft;

DETAILED DESCRIPTION OF THE DRAWINGS

Figure 1:
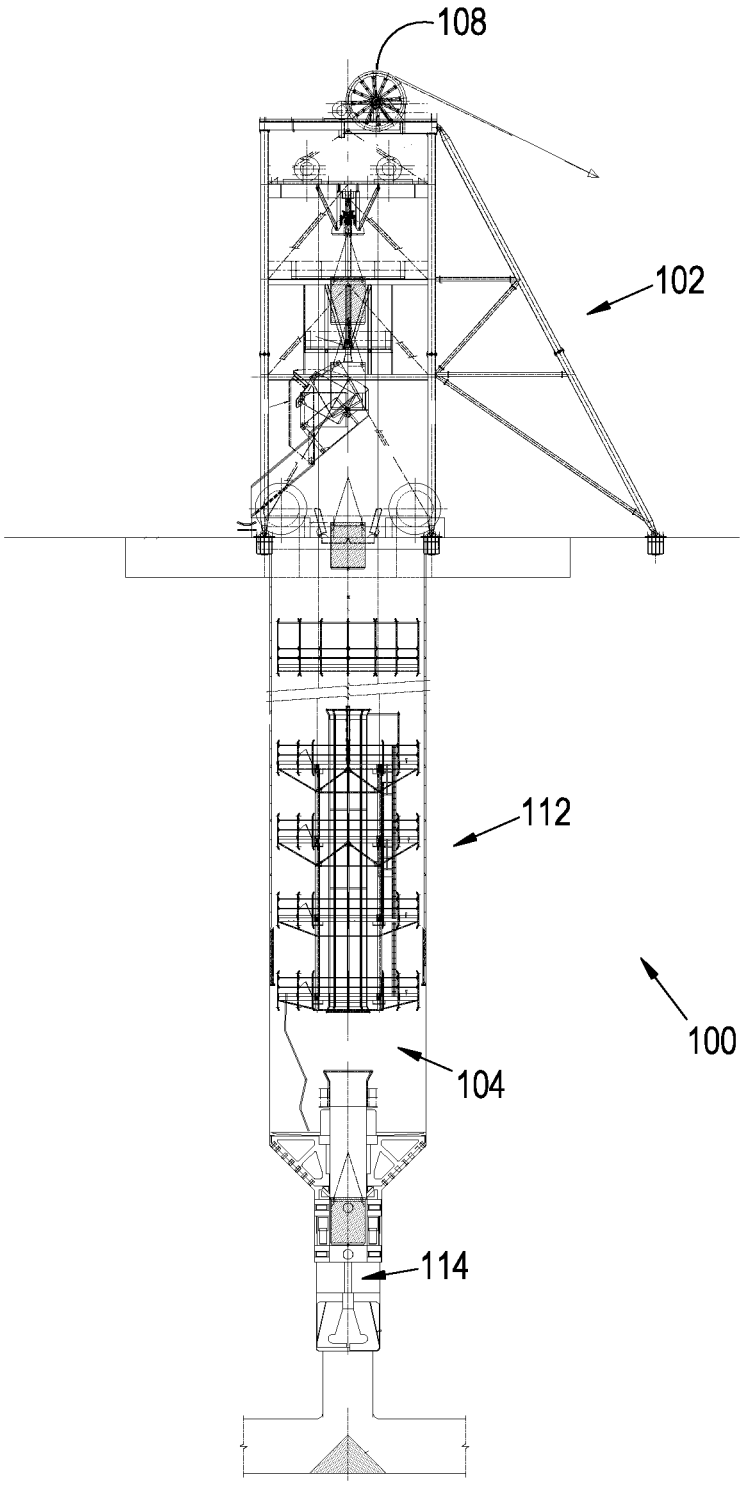
FIG. 1 shows a side view of a first version of a boring system, utilising one version of a shaft enlargement arrangement according to the present invention.
Figure 2:
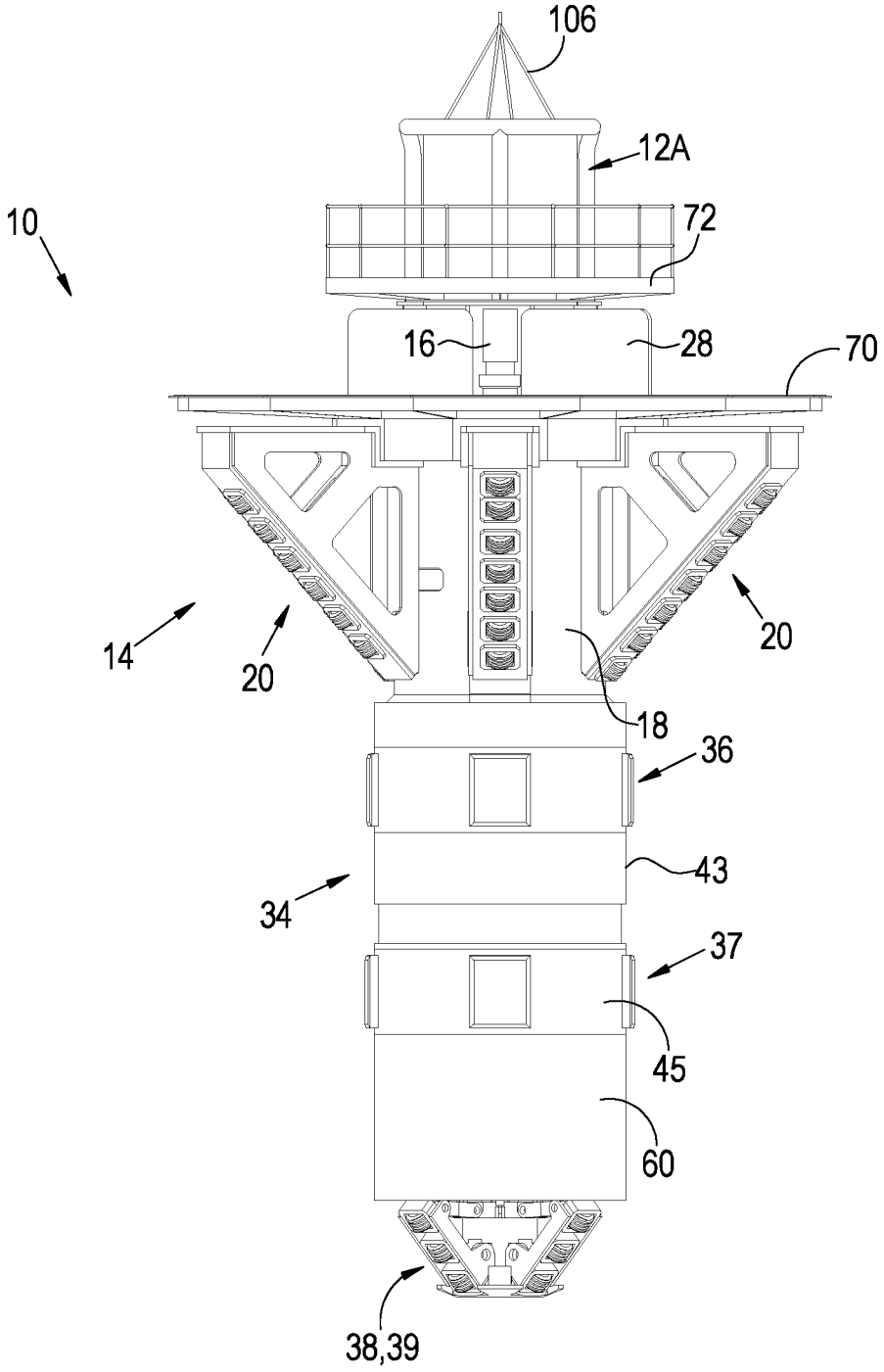
FIG. 2 shows a side view of a shaft enlargement arrangement for a boring system, according to an embodiment of the present invention.
Figure 3:
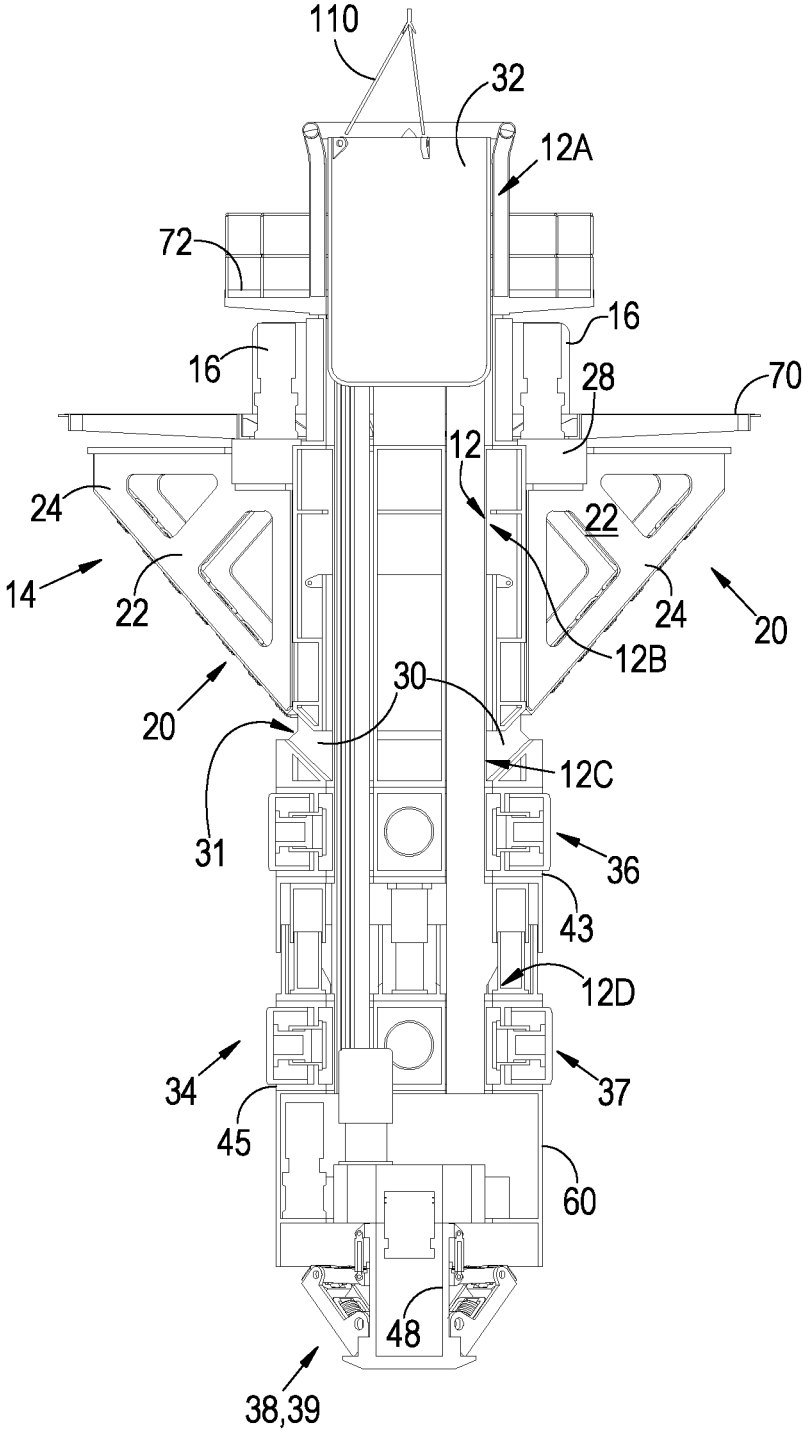
FIG. 3 shows a cross-sectional side view of the shaft enlargement arrangement shown in FIG. 2.

Referring first to FIG. 1, a boring system 100 which may use a shaft enlargement arrangement 10 of the present invention is shown. In broad terms, the boring system 100 comprises an aboveground support rig arrangement 102 comprising an overhead support assembly 102. A winch is provided to move the shaft enlargement arrangement 10 up and down as and when required within the drilled shaft or bore 104, via ropes or cables 106 (as best shown in FIG. 2) extending between the winch and the shaft enlargement arrangement 10. A kibble winder 108 is also provided to move a kibble 32 up and down as and when required, through a hollow column 12 of the arrangement 10, also via ropes or cables 110 (as best shown in FIG. 3) extending between the kibble winder 108 and the kibble 32. Other components on surface include maintenance winders, a crosshead arrester, and a kibble tilting arrangement to tilt the kibble 32 on surface in order to dispose of the cuttings within the kibble 32.

Within the drilled shaft or bore 104, but above the shaft enlargement arrangement 10, a plurality of support decks 112 are provided, which serve various purposes such as an operators deck, a drill support and slurry operation deck, a hydraulic and electrical support work deck, and a bottom working/shuttering deck for allowing the bore 104 to be lined.

Figure 4:
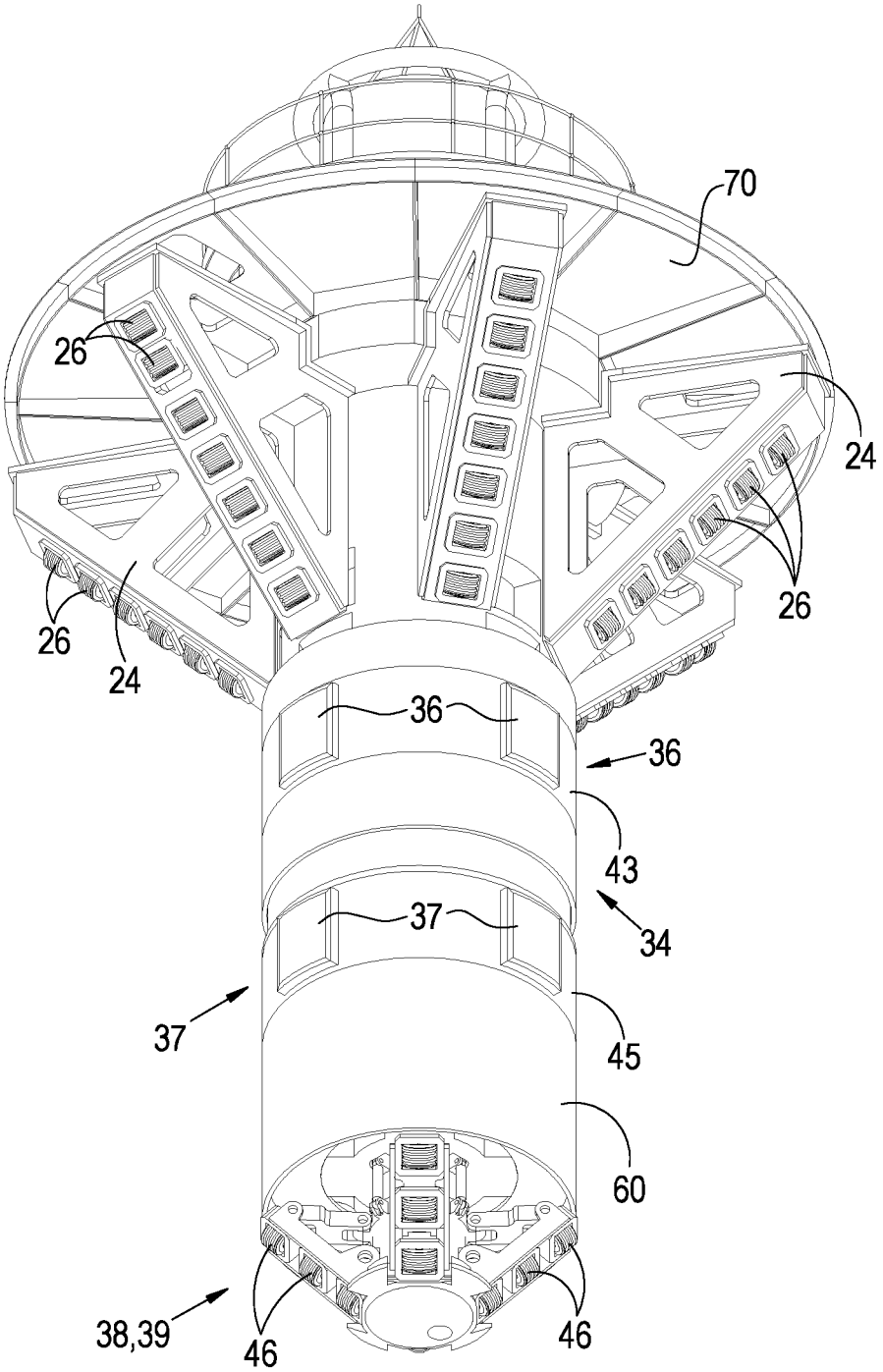
FIG. 4 shows a bottom perspective view of the shaft enlargement arrangement shown in FIGS. 2 and 3.
Figure 5:
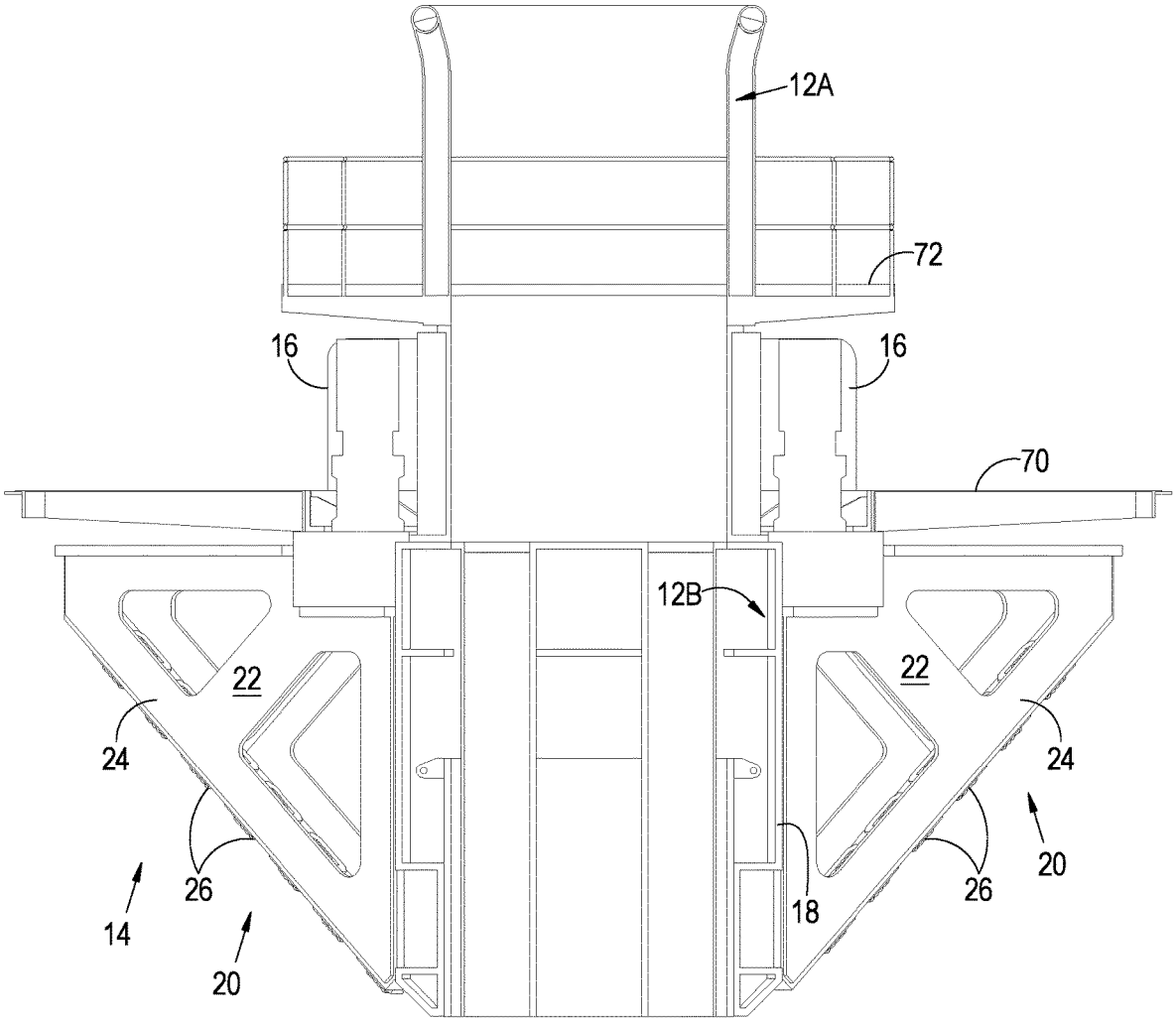
FIG. 5 shows a detailed cross-sectional side view of a first cutter head arrangement used in the arrangement shown in FIGS. 2 to 4.

Turning now to FIGS. 2 to 4, a shaft enlargement arrangement 10 for a boring system, such as the system shown in FIG. 1, is shown, the shaft enlargement arrangement 10 comprising a hollow column 12 proximate a lower end of the boring system. The column 12 includes an upper section 12A, an intermediate section 12B and a lower section 12C. The column 12 further includes a telescoping portion 12D that is axially movable relative to the rest of the hollow column 12A, 12B and 12C, which will be described in more detail further below.

A first cutter head arrangement 14, corresponding to a reamer section, is rotatably fitted to the hollow column 12, and in particular to the intermediate section 12B of column 12. Drive means in the form of electric motors 16 are provided to rotate the first cutter head arrangement 14 relative to (i.e. around) the hollow column 12. This causes the hole 104 to be downwardly bored having a diameter corresponding substantially to the diameter of the first cutter head arrangement 14. The column 12 typically comprises a double wall so as to define ventilation and/or cooling ducts.

The first cutter head arrangement 14 comprises a support body 18 carrying a winged arrangement 20, the support body 18 being rotatably fitted to the column 12. The winged arrangement 20 comprises a plurality of substantially triangular wings 22 fitted to the support body 18. Each wing 22 has an angled or transversely extending, typically at 45 degrees, support beam 24 to which is fitted, or which comprises, a plurality of first cutter elements 26 extending along the length of the beam 24. The angled support beams 24 are arranged to define a substantially V-shaped cutting profile when in use.

In an embodiment, a gearing housing 28 is mounted above the first cutter head arrangement 14, with the first drive means being fitted atop the gearing housing 28 and arranged to drive a gearing arrangement within the gearing housing 28. This in turn is arranged to rotate the support body 18 and thus the first cutter head arrangement 14 around the column 12. Typically, the electric motors 16 of the first drive means are arranged around the periphery of the gearing housing 28.

In an embodiment, each wing 22 is removably fitted or fittable to the support body, so that wings 22 of different sizes may be interchanged, to enable holes of varying diameters to be bored.

As best shown in FIG. 3, at least one collecting channel 30 is defined in the hollow column 12, proximate the juncture between the intermediate section 12B and the lower section 12C, below the first cutter head arrangement 14 into which cuttings produced by the rotating first cutter head arrangement 14 can be collected, as indicated by arrow 31. The collecting channel 30 defines an inlet to receive the cuttings, an outlet through which the cuttings can exit the channel into the column, with a downwardly angled passageway being provided between the inlet and outlet to facilitate the passage of cuttings into the column 12, and in particular the lower section 12C, under the influence of gravity. This may then be collected by a kibble 32 travelling up and down the column 12.

Typically, the shaft enlargement arrangement 10 includes a pair of diametrically opposed collecting channels 30, as best shown in FIG. 3, with the lowermost portions of the winged arrangement 20 including scrapers (not shown) to scrape the cuttings into the collecting channels 30 as the first cutter head arrangement 14 rotates around the column 12.

Figure 6:
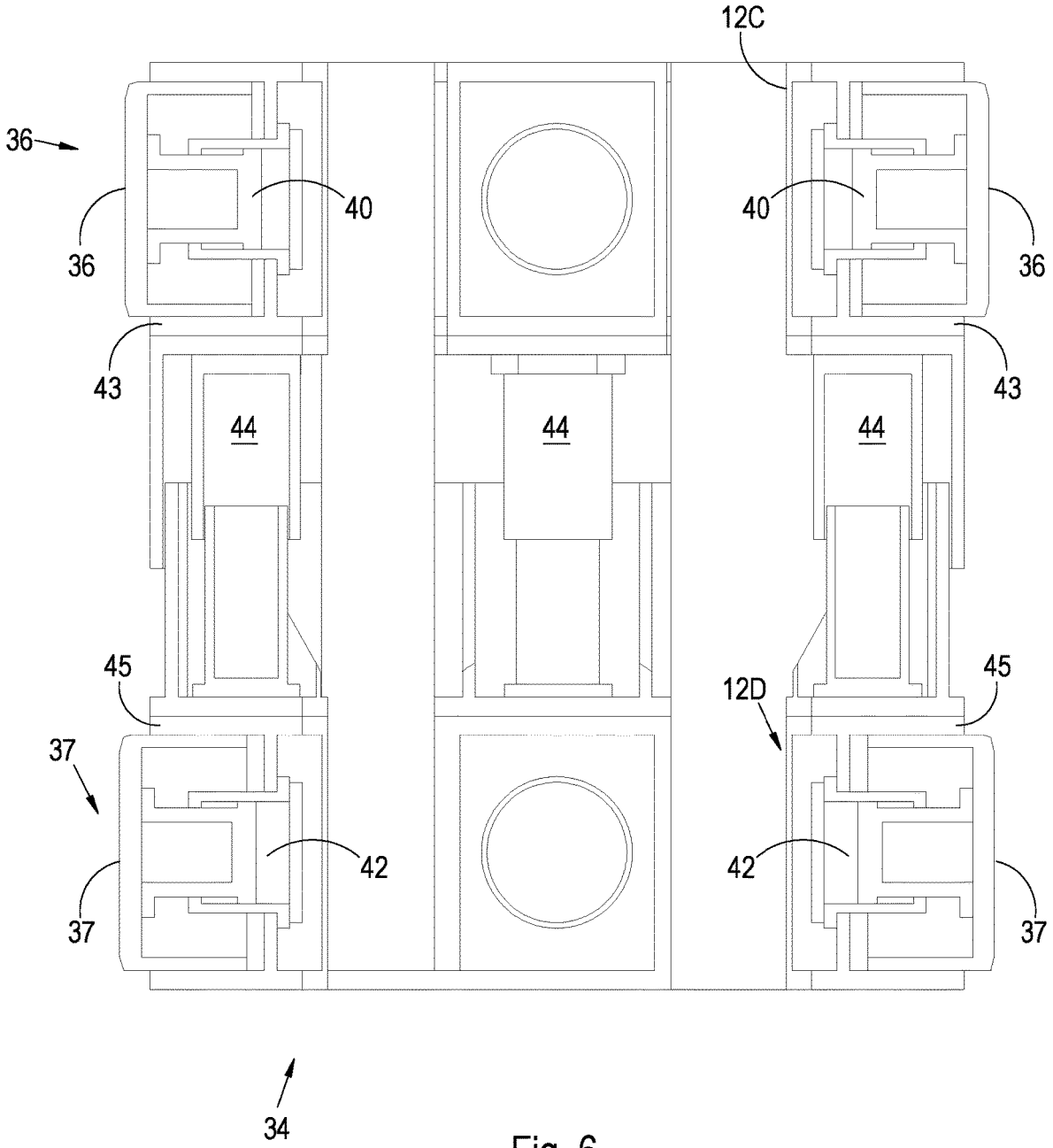
FIG. 6 shows a detailed cross-sectional side view of a gripper arrangement used in the arrangement shown in FIGS. 2 to 4.

In an embodiment, the shaft enlargement arrangement 10 includes a gripper arrangement 34 fitted to (i.e. around) the hollow column 12, which will now also be described with reference to FIG. 6. In particular, the gripper arrangement 34 includes a first series of circumferentially spaced gripper pads 36 that are positioned, in use, below the collecting channels 30, and a second series of circumferentially spaced gripper pads 37 that are positioned, in use, below the first series of gripper pads 36 and above a boring head arrangement 38 (which will be described in more detail further below). The gripper arrangement 34 is arranged to securely grip against the leading hole 114 bored by a second cutter head arrangement 39 of the leading boring head arrangement 38, so as to secure the boring system 100 in position within the bored hole 104.

The first and second series of gripper pads 36, 37 extend sidewardly away from the hollow column 12; in particular, the first series of gripper pads 36 extends away from the intermediate section 12B of the column 12, and through an outer shield 43. Similarly, the second series of gripper pads 37 extends away from the lower, telescoping section 12D of the column 12 and through an outer shield 45. The gripper pads 36, 37 are movable, by means of first and second actuator arrangements 40, 42, respectively, between a retracted, disengaged position and an extended, engaged position in which the pads 36, 37 clamp against the leading hole 114 defined by the second cutter head arrangement 39, to facilitate and/or control rotation of the first cutter head arrangement 14.

The lower, telescoping section 12D of the column 12 is axially movable relative to the rest of the column 12 by means of a third actuator arrangement 44 in the form of a plurality of hydraulic thrust cylinders, to define a thrust section to allow the boring head arrangement to advance relative to the reamer section. This relative axial movement provides thrust and steering functionality, and typically comprises four hydraulic thrust-cylinders which inter-connect the lower and intermediate sections 12C, 12B of the column 12. The thrust and steering would typically work in association with the clamping feature of the gripper pads 36, 37, so that when the gripper pads 36, 37 are in their extended clamped configuration, the third actuator arrangement 44 may actuate the downward, boring action of the boring head arrangement 38.

The boring head arrangement 38 is fitted to an operatively lower end of the column 12, and in particular to the lower end of the telescoping portion 12D. In one version, the boring head arrangement 38 is removably fitted to an operatively lower end of the column 12, so that it may be separated from the rest of the shaft enlargement arrangement 10 if/when needed, as will be described in more detail further on in the specification.

Figure 7:
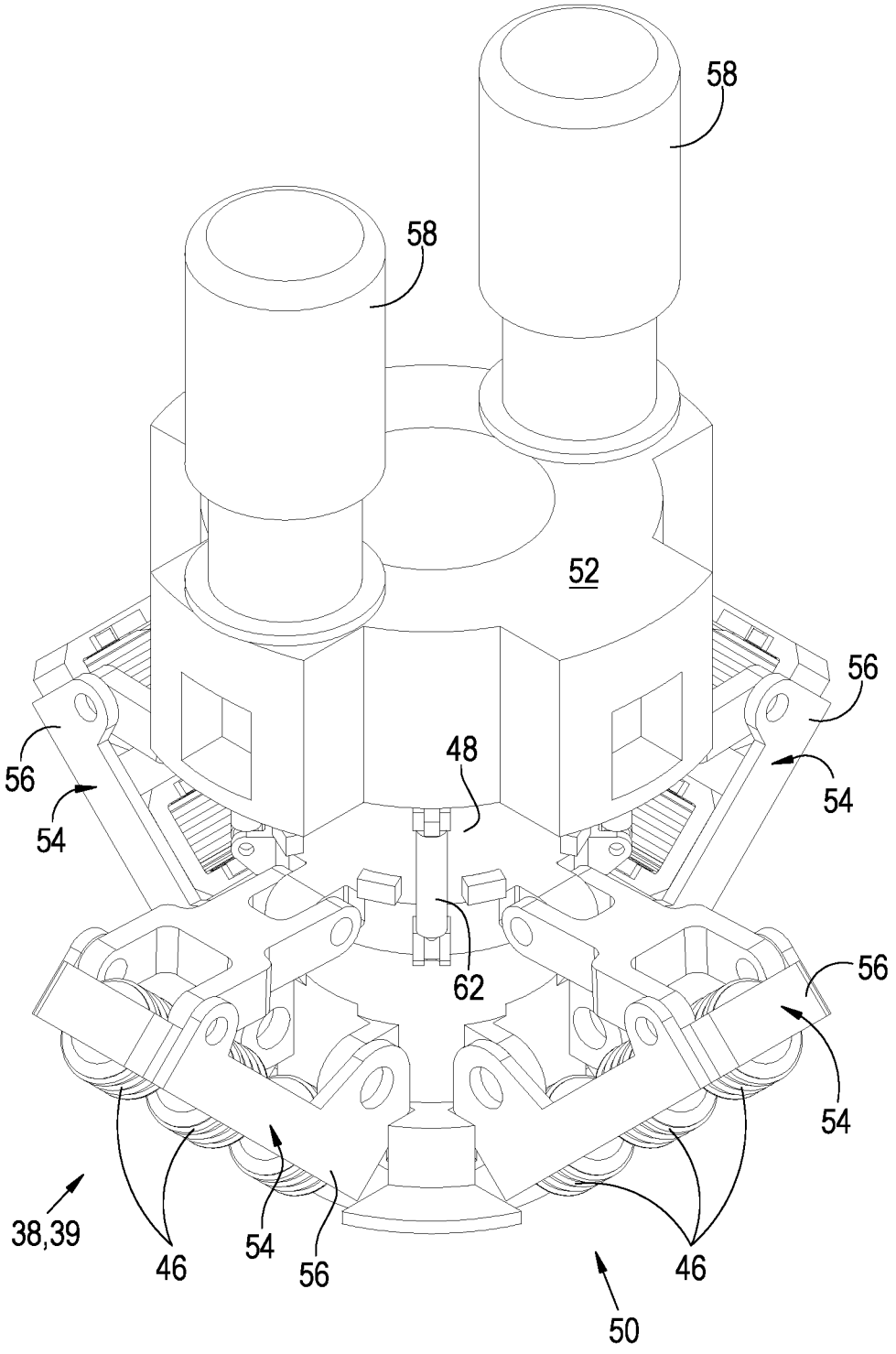
FIG. 7 shows a perspective view of a second cutter head arrangement, in the form of a slurry reamer, used in the arrangement shown in FIGS. 2 to 4.
Figure 8:
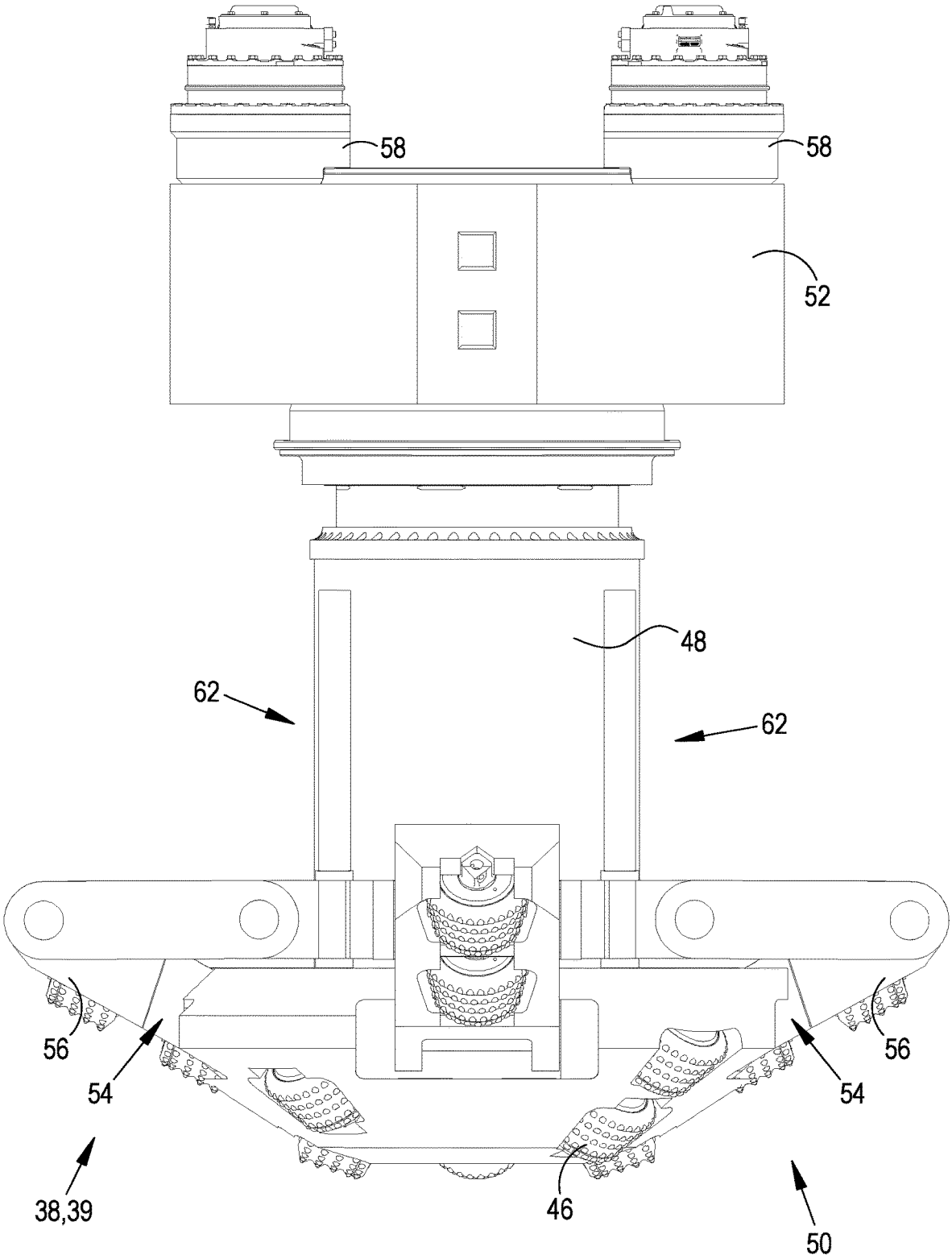
FIG. 8 shows a side view of the second cutter head arrangement shown in FIG. 7, in an extended, operational configuration.
Figure 9:
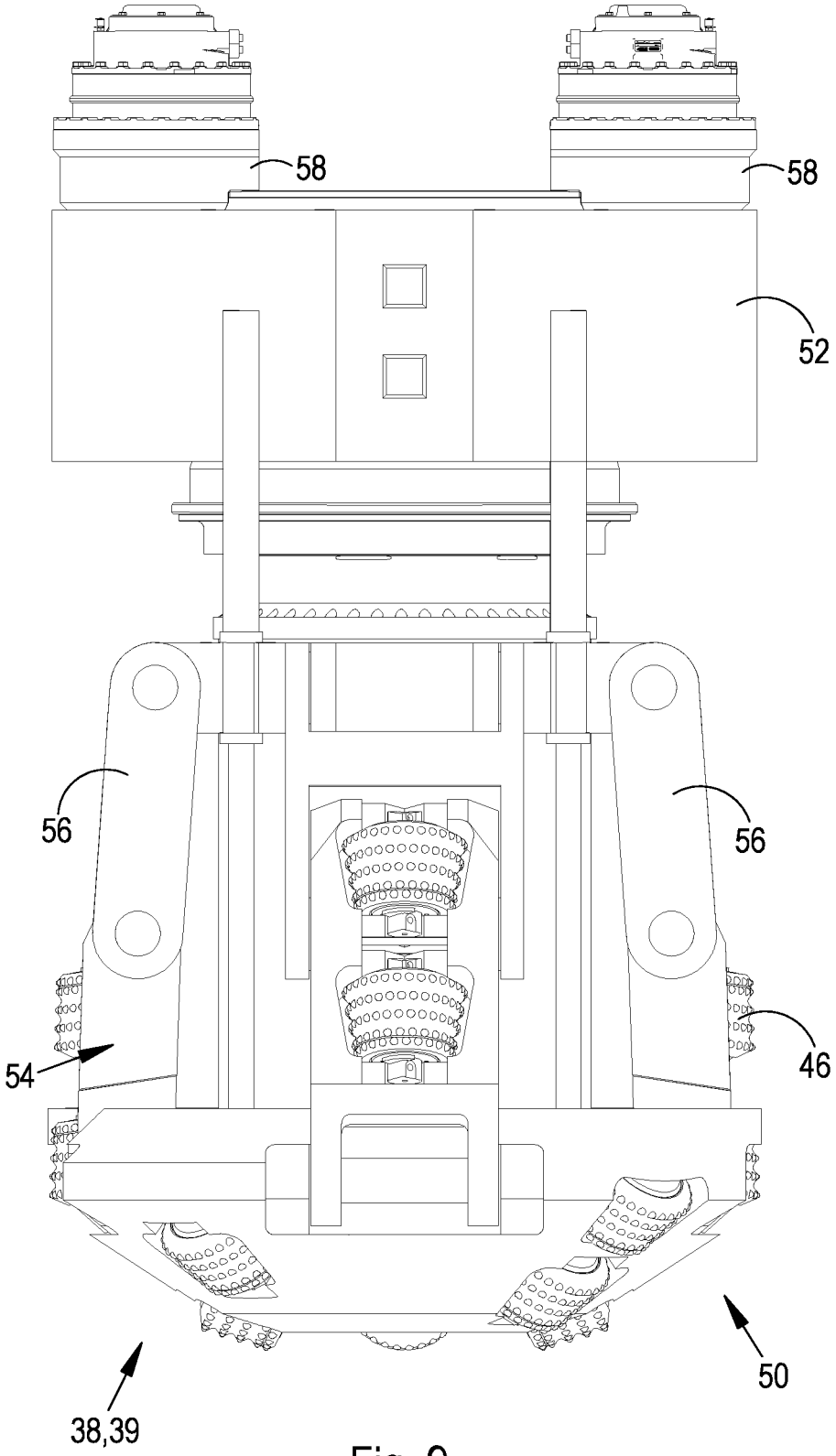
FIG. 9 shows a side view of the second cutter head arrangement shown in FIG. 7, in a collapsed configuration

The boring head arrangement 38 terminates in the second cutter head arrangement 39 to bore a leading hole 114 as the boring system 100 proceeds to bore downwardly, as will now be described with reference to FIGS. 7 to 9. The second cutter head arrangement 39 is typically fitted with, or includes, a plurality of second cutter elements 46. In an embodiment, the second cutter head arrangement 39 comprises a support body 48 carrying a second winged arrangement 50, the support body 48 being rotatable relative to a support housing 52 from which it extends.

The second winged arrangement 50 comprises a plurality of wings 54 fitted to the support body 48. Each wing 54 has an angled or transversely extending, typically at 45 degrees, wing arm 56 to which is fitted, or which comprises, a plurality of second cutter elements 46. The angled wing arms 56 are arranged to define a substantially V-shaped cutting profile.

In an embodiment, second drive means 58 are fitted atop the support housing 52 and are arranged to drive a gearing arrangement within the support housing 52, which in turn is arranged to rotate the support body 48 and second cutter head arrangement 39. Typically, the second drive means 58 comprises a plurality of electric motors arranged around the periphery of the support housing 52.

As best shown in FIGS. 2 to 4, a shield 60 surrounds the support housing 52 and second drive means 58, with the support housing 52 and/or second drive means 58 being secured to the end of the hollow column 12.

Turning back to FIGS. 7 to 9, fourth actuator means 62 are provided to pivotally move the wing arms 56 relative to the support body 48, between an extended, operational V-shaped configuration, to facilitate boring, as shown in FIGS. 7 and 8, and a collapsed, substantially aligned (typically parallel) configuration, to enable the second cutter head arrangement 39 to be detached from the rest of the shaft enlargement arrangement 10 and pulled up through the hollow column 12 to surface, as shown in FIG. 9. The diameter of the collapsed second cutter head arrangement 39, which corresponds substantially to the diameter of the support housing 52, is thus less than the diameter of the hollow column 12, to facilitate this removal.

The fourth actuator means 62 typically takes the form of a hydraulic piston to act upon a lever member extending between the piston and the end of the wing arm 56, so as to pivot the wing arm 56 between the two configurations.

In an alternate embodiment, the boring head arrangement 38 comprises a slurry boring head terminating in an operatively flat face to define a slurry shield, the flat face being fitted with the second cutter head arrangement to bore the leading hole as the boring system progresses downwardly. In this embodiment, the second cutter head arrangement may be fitted with, or include, a plurality of second cutter elements, with drive means being provided to drive the second cutter elements of the slurry boring head.

The shaft enlargement arrangement 10 typically includes a pair of platforms 70, 72, as best shown in FIG. 2, fitted to the hollow column 12 above the first cutter head arrangement 14, to support personnel conducting shaft lining and/or maintenance operations.

Figure 10:
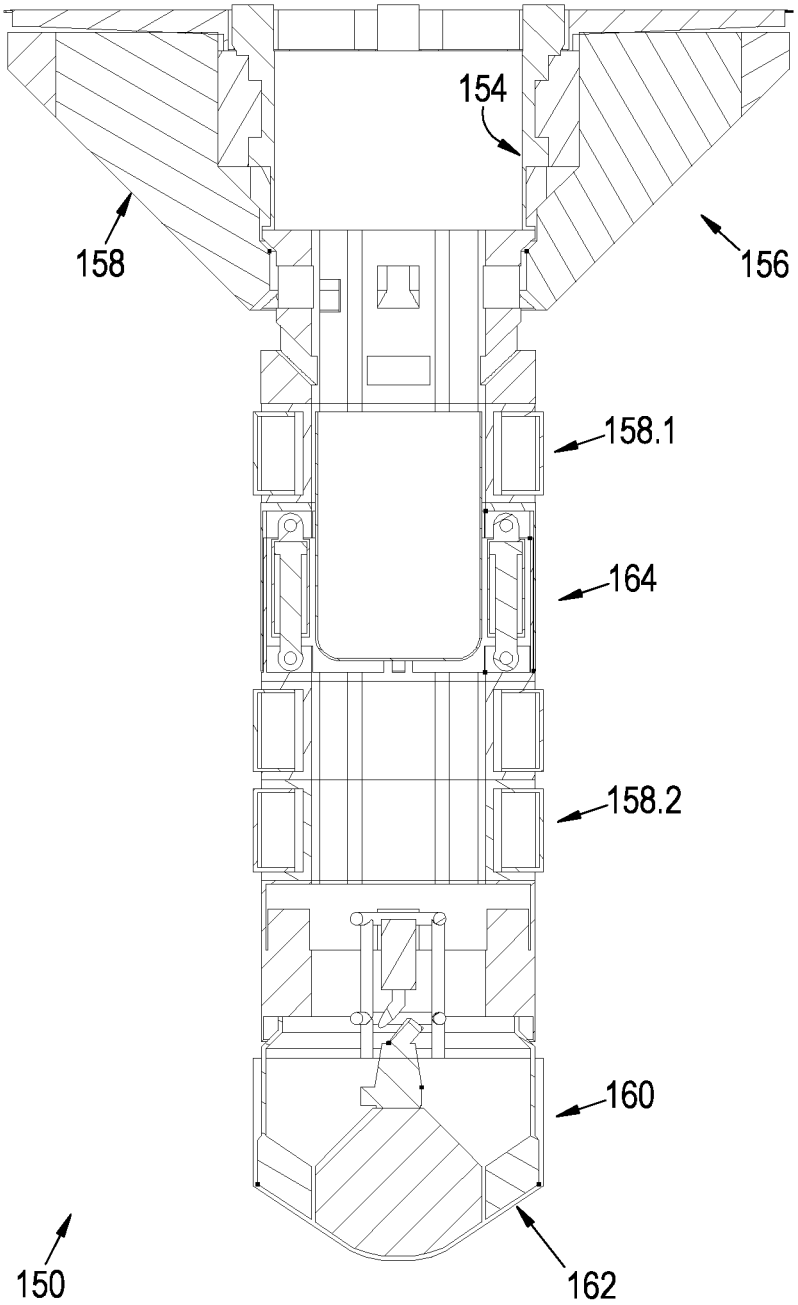
FIGS. 10 and 11 show cross-sectional and side views of a shaft enlargement arrangement for a boring system, according to another embodiment of the present invention.
Figure 11:
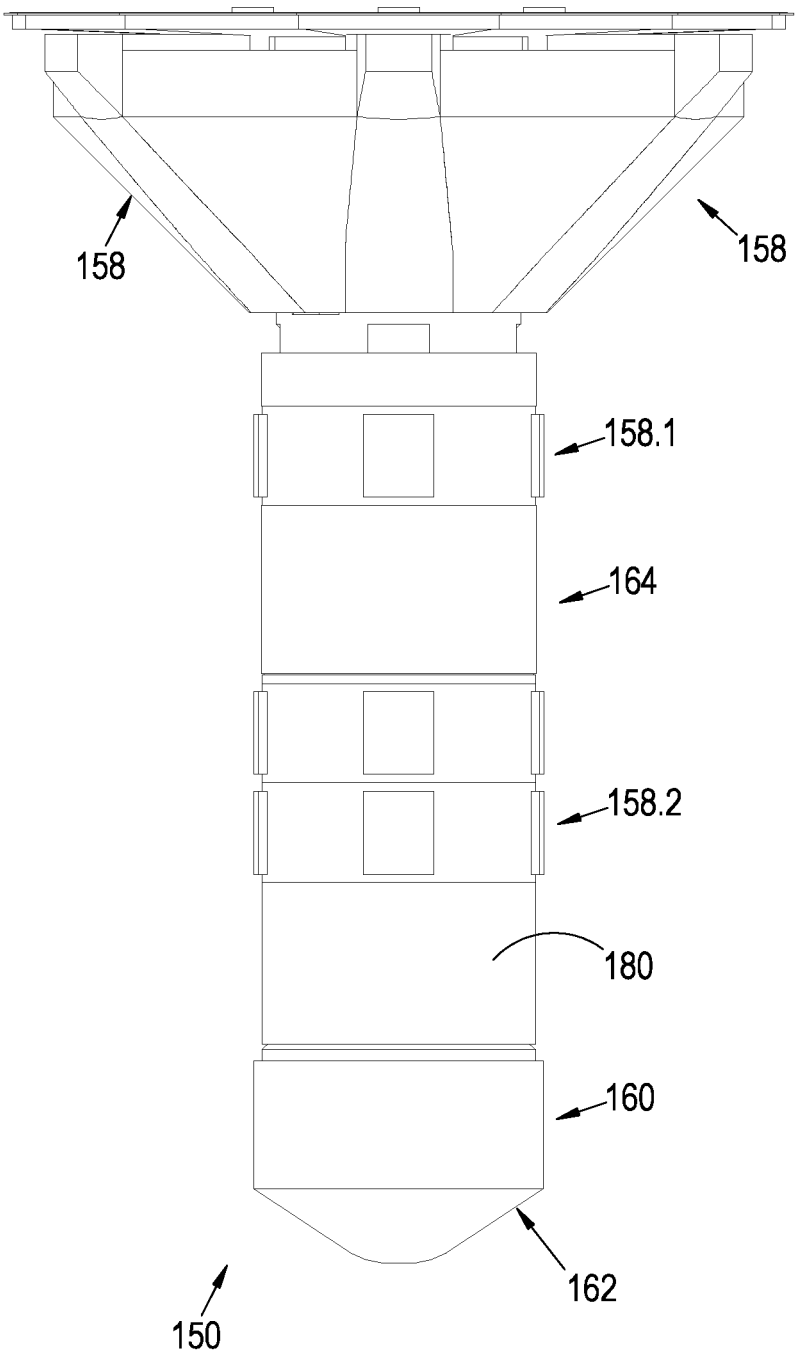
Figure 16:
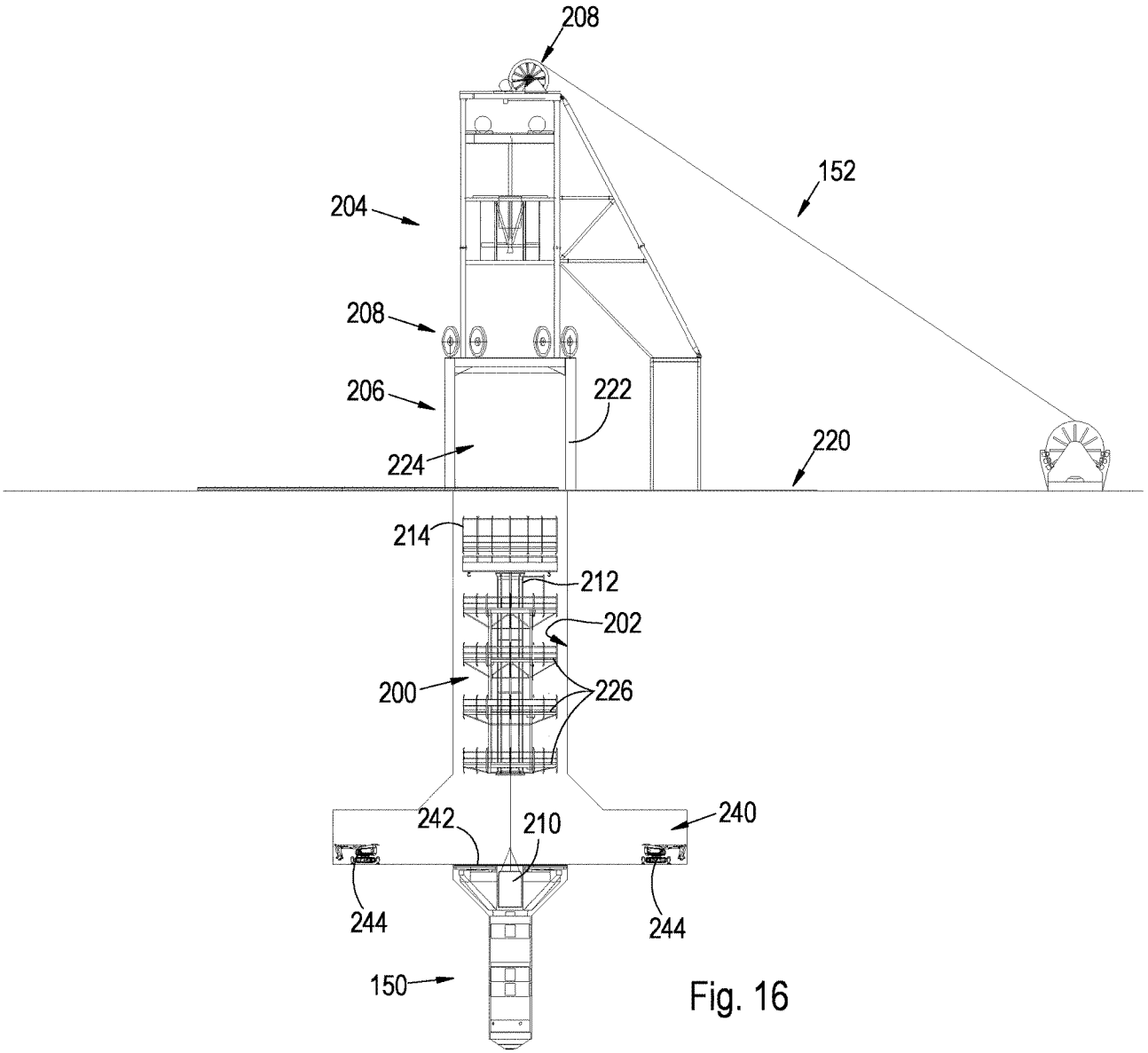
FIG. 16 shows the ability of the boring system using the shaft enlargement arrangement shown in FIGS. 10 and 11 to allow a level break away to be formed, wherein the shaft enlargement arrangement can be decoupled from the rest of the boring system.
Figure 17:
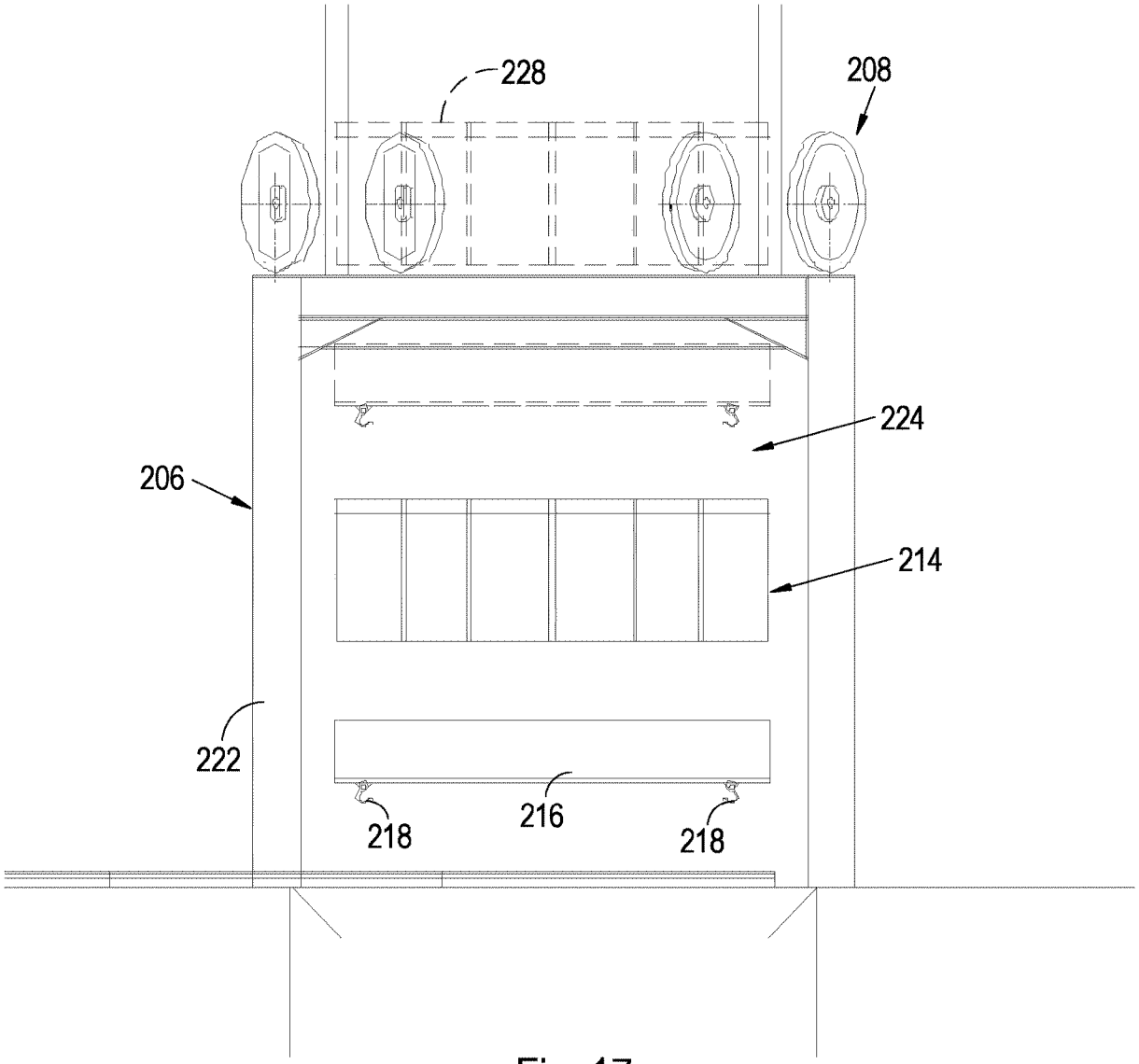

Turning now to FIGS. 10 and 11, a shaft enlargement arrangement 150 for a boring system 152 (as best shown in FIG. 16) according to a second version is shown. The shaft enlargement arrangement 150 comprises a hollow column 154 proximate a lower end of the boring system 152. A reamer section 156 comprises a downwardly tapering first cutter head arrangement 158 that is rotatably fitted to the hollow column 154. Although not shown in these drawings, first drive means is provided to rotate the first cutter head arrangement 158 relative to the hollow column 154 so as to bore downwardly a hole having a diameter corresponding substantially to the diameter of the first cutter head arrangement 158.

The shaft enlargement arrangement 150 further comprises a boring head arrangement 160 fitted to an operatively lower end of the enlargement arrangement 150. The boring head arrangement 160 terminates in a downwardly tapering second cutter head arrangement 162 to bore a leading or pilot hole, having a diameter that is less than the diameter of the first cutter head arrangement 158, as the boring system 152 proceeds to bore downwardly.

In between the first and second cutter head arrangements 158, 162, there is provided a thrust section 164 to allow the boring head arrangement 160 to advance relative to the reamer section 156, and a gripper arrangement 158.1, 158.2 to secure the shaft enlargement arrangement 150 within the bored hole and to control the advancing of the boring head arrangement 160 relative to the reamer section 156. The operation of the thrust section 164 and the gripper arrangement 158.1, 158.2 is largely as described above, and will thus not be repeated.

Figure 12:
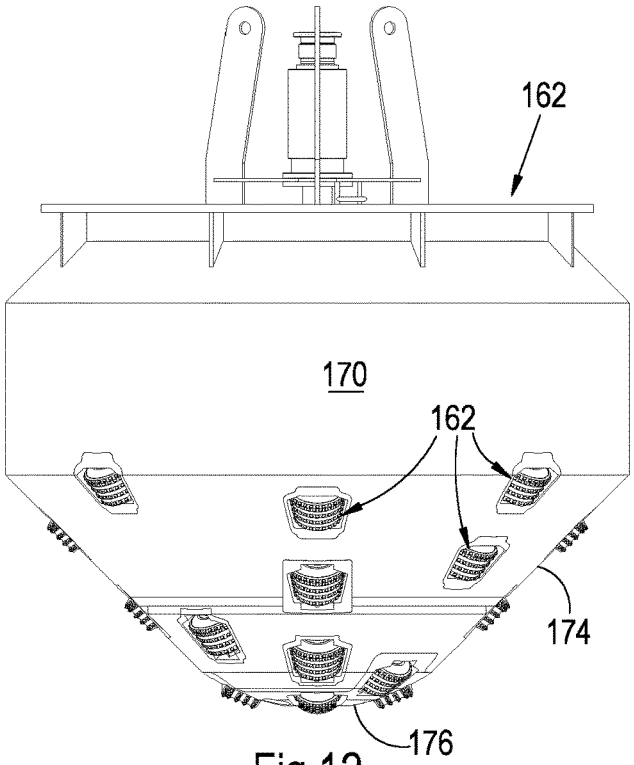
FIGS. 12 and 13 show side and cross-sectional views of a slurry boring head arrangement used in the shaft enlargement arrangement shown in FIGS. 10 and 11.
Figure 13:
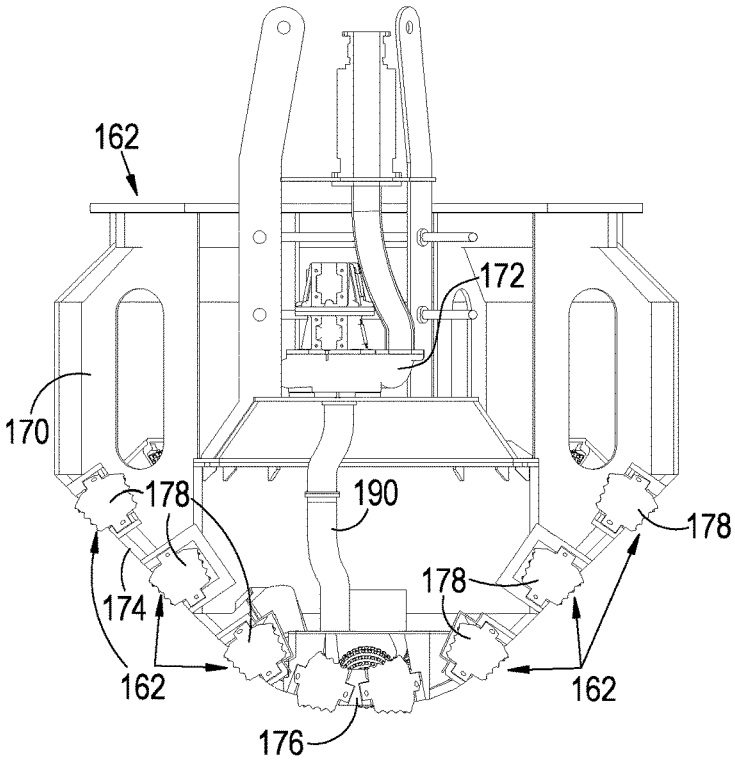

As best shown in FIGS. 12 and 13, the boring head arrangement 160 comprises a frusto-conical slurry boring head 170 having a slurry pump 172, the slurry boring head 170 comprising a tapering side wall 174 terminating in an end flat face 176, the tapering side wall 174 and/or the end flat face 176 being fitted with the second cutter head arrangement 162 to bore the leading hole as the boring system 152 progresses downwardly. In this embodiment, the second cutter head arrangement 162 may be fitted with, or include, a plurality of second cutter elements 178.

The boring head arrangement 160 comprises a support housing with the slurry boring head 170 being rotatable relative to the support housing, typically using a rotary swivel known in the art. As described above, although not shown here, second drive means are fitted atop the support housing and arranged to drive a gearing arrangement within the support housing, which in turn is arranged to rotate the slurry boring head 170 relative to the support housing. Typically, the second drive means comprises a plurality of electric motors arranged around the periphery of the support housing. The rotary swivel is able to handle different media types and related pressures, such as hydraulic oil and slurry water.

As best shown in FIG. 11, a shield 180 surrounds a portion of the slurry boring head 170, the shield 180 extending upwardly towards the gripper arrangement 158.2.

Figure 14A:
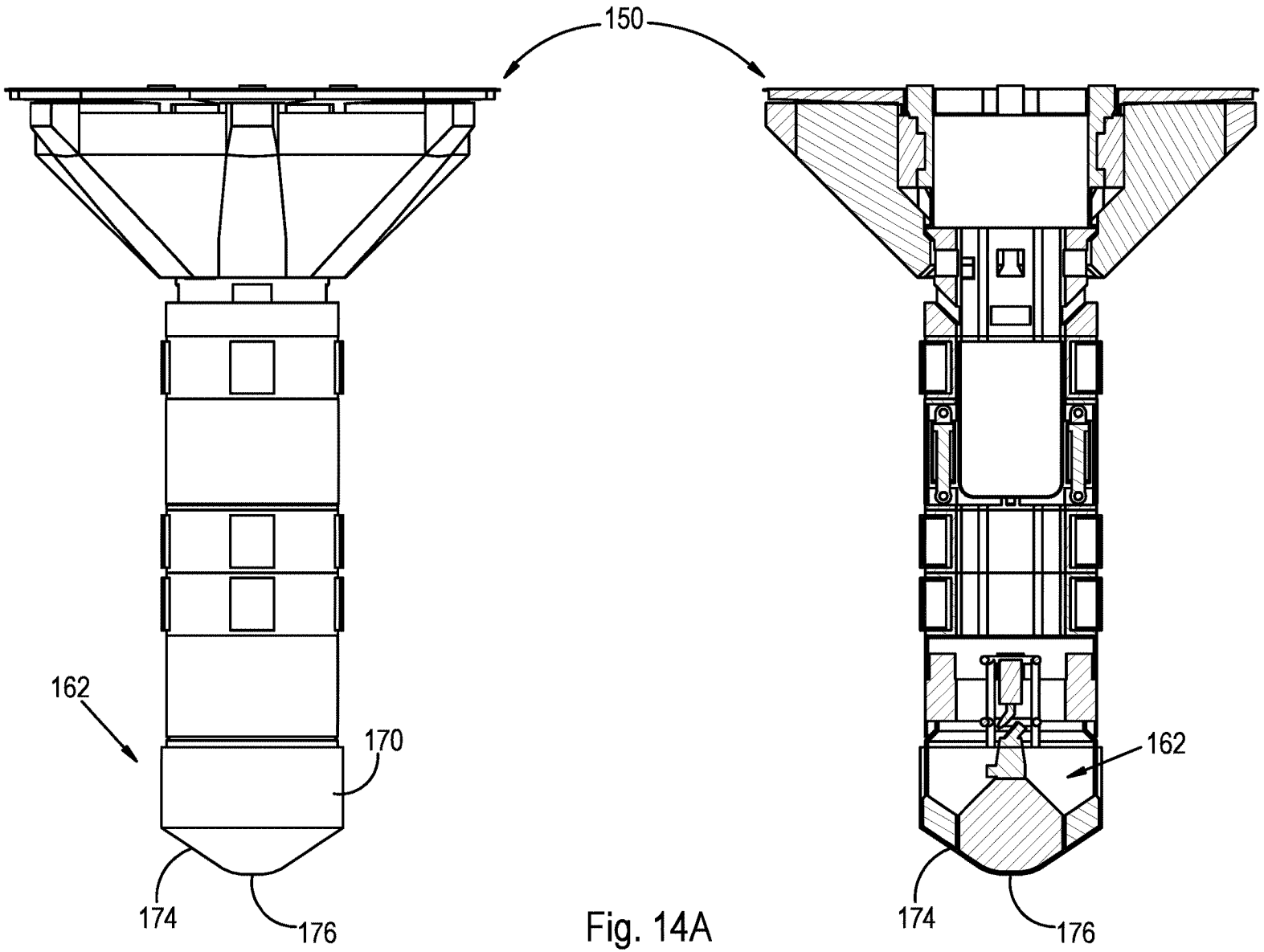
FIG. 14 shows a series of steps followed to remove a component of the slurry boring head from the rest of the slurry boring head arrangement shown in FIGS. 12 and 13.
Figure 14B:
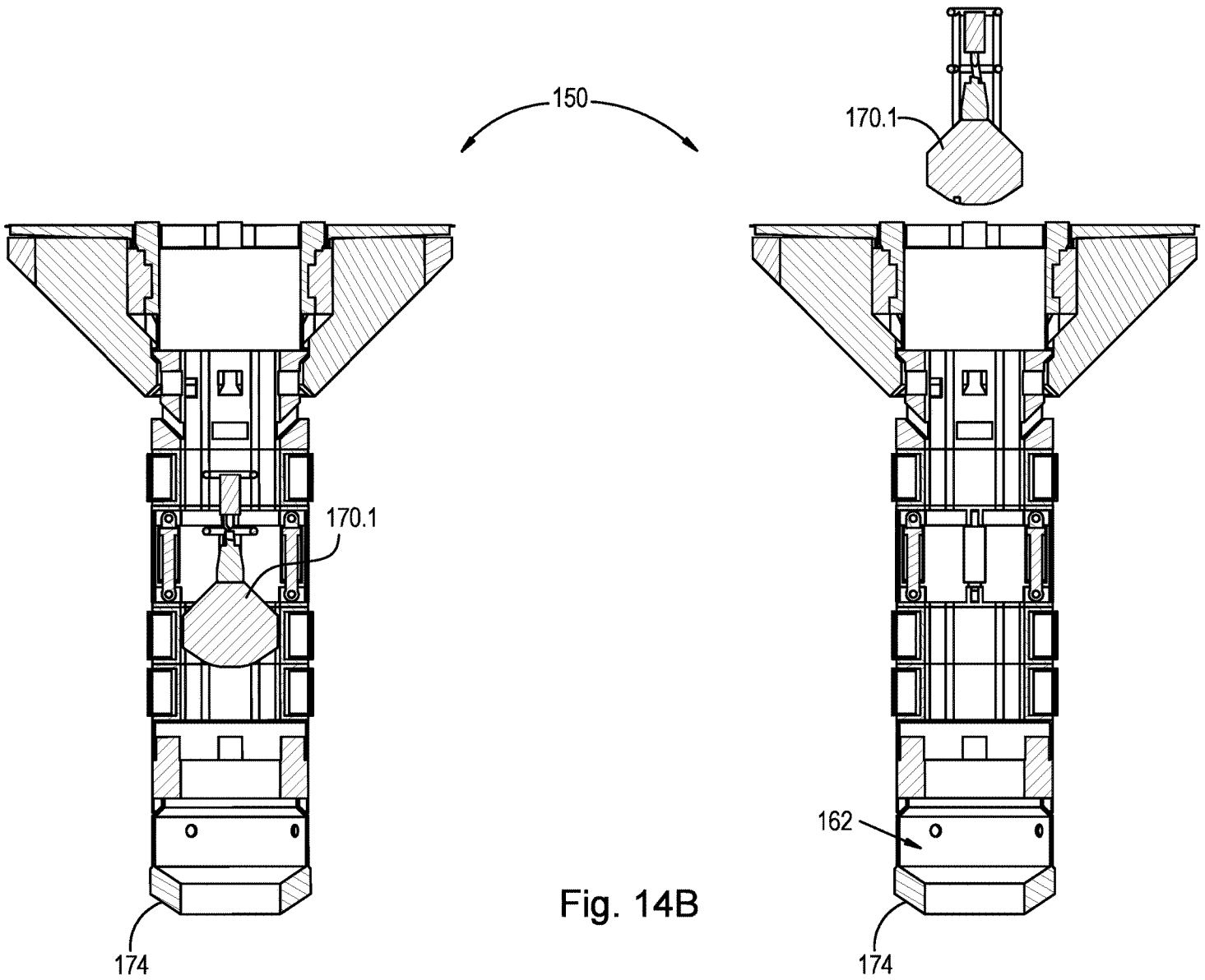

Turning now to FIG. 14, a section 170.1 of the slurry boring head 170 can be separated and removed from the slurry boring head 170, the removable section 170.1 including at least the end flat face 176 and the slurry pump 172. The removable section 170.1 of the slurry boring head 170 results in a number of advantages. For example, when the removable section 170.1 is removed, it allows access to the cutting face 174, 176 without having to remove the entire shaft enlargement arrangement 150 up to surface. This allows maintenance on the cutting face 174, 176 to be performed in an extremely versatile and efficient manner. The weight of the removable section 170.1 is determined by the lifting capacity of the kibble winder (as described above and further below), which may now also be used to lift the removable section 170.1. When the removable section 170.1 is hoisted to surface, maintenance and repairs including cutter 178 changes and slurry pump 172 repairs etc. can be performed. The removable section 170.1 of the slurry boring head 170 has front loading cutters, while the rest of the slurry boring head 170 has back loading cutters. This arrangement allows the cutters of the removable part 170.1 to be changed on surface without the need to remove the slurry pump 172, for example.

Figure 15:
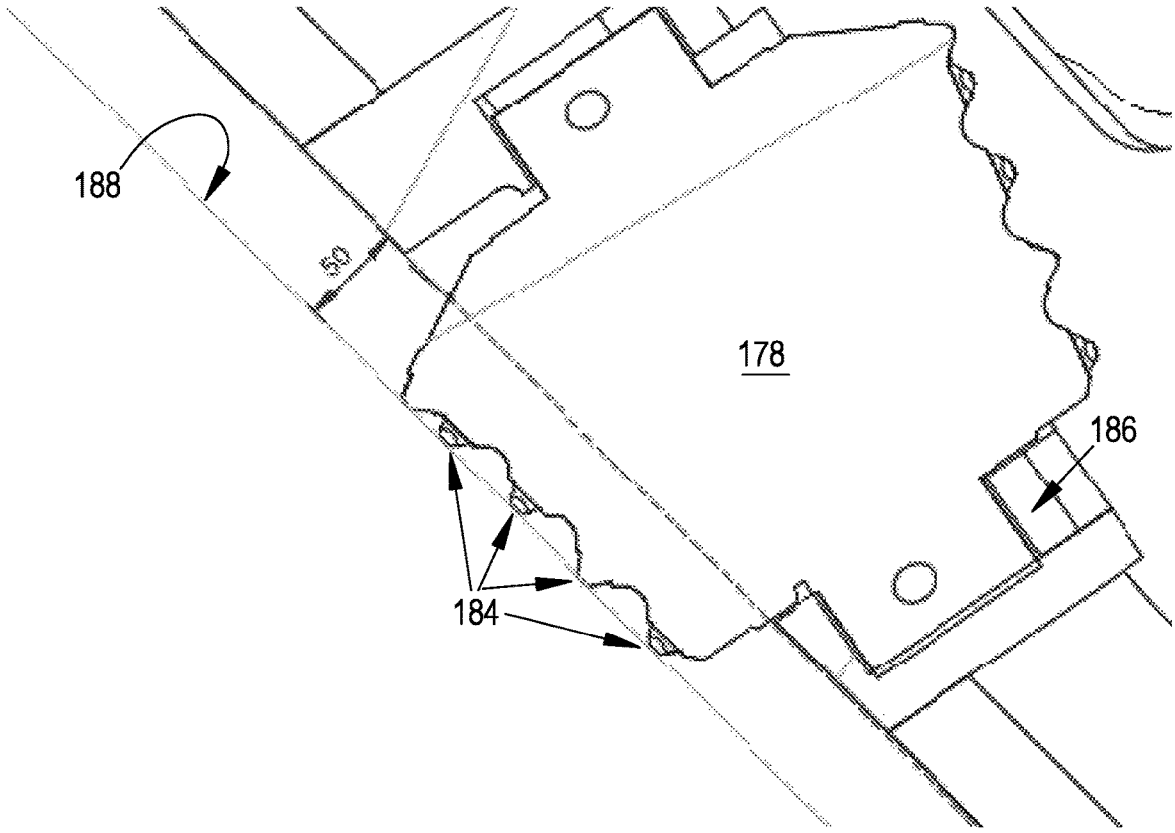
FIG. 15 shows a detailed view of the cutter layout and spacing used in the slurry boring head arrangement shown in FIGS. 12 and 13.

Turning now to FIG. 15, each of the second cutter elements 178 comprises a working face 182 from which a plurality of rows 184 of buttons extend, the second cutter elements 178 being rotatably accommodated within a cavity 186. The rows 184 of buttons are spaced approximately 25 mm apart, which ensures that the rock chips produced by the interaction between the buttons and the cutting face 188 have a size of approximately 25 mm. In addition, the working face 182 of the cutter element 178 is spaced approximately 50 mm away from the cutting face 188. This is important to accommodate the water flow requirements needed to keep the rock chips suspended and to suck the chips away from the cutting face 188 by the slurry pump 172 up to a separation plant, since the further the working face 182 is from the cutting face 188, the higher the water flow required. When the spacing is 50 mm, particles bigger than 50 mm are prevented from being sucked into the slurry pump 172, which could block the suction nozzle of the slurry pump 172 (which is typically restricted to accommodating particles of 50 mm). This arrangement thus helps to regulate the particle size entering the slurry pump 172. Also, when drilling in ground conditions where water may be problematic, such as salt and potash mines, this particular spacing arrangement will enable the use of a vacuum system instead of a slurry pump system, should this be required or desired, as described further below with reference to FIG. 20.

In addition, the suction nozzle 190 of the slurry head 172, as shown in FIG. 13, is on a specific radius on the slurry cutter head, to ensure that all the rock cuttings are cleared from underneath the cutter face. The suction nozzle 190 diameter is approximately 150 mm, to accommodate a sufficiently high water flowrate of the water to ensure that the rock cuttings become entrained.

Turning now to FIG. 16, the boring system 152 includes a plurality of support decks 200 locatable above the shaft enlargement arrangement 150, within the hole 202 bored by the first cutter head arrangement 158. In an embodiment, the shaft enlargement arrangement 150 may be separated or decoupled from the plurality of support decks 200.

The boring system further includes an aboveground support rig arrangement 204 comprising an overhead support assembly 206 and a headgear arrangement 208 to lift and lower the shaft enlargement arrangement 150 and the plurality of support decks 200. The headgear arrangement 208 typically comprises at least:

- a winch to move the shaft enlargement arrangement up and down as and when required within the shaft 202, via ropes or cables extending between the winch and the shaft enlargement arrangement 150;
- a kibble winder to move a kibble 210 up and down as and when required, through the hollow column 154 and through a hollow column 212 to which the stages 200 are fitted, via ropes or cables extending between the kibble winder and the kibble 210; and
- a deck winder to move the plurality of support decks 200 up and down as and when required.

In an embodiment, a mobile service deck 214 is provided above the plurality of support decks 200, to which a spreader bar 216 (having end hooks 218) is connected or connectable. The mobile service deck 214 can be lifted, separated and temporarily accommodated between the headgear arrangement 208, to enable the spreader bar 216 to be used to fetch a component or item within the shaft 202 and hoist it to surface 220.

In particular, the overhead support assembly 206 comprises a lower support frame 222 that defines a zone 224 to accommodate the mobile service deck 214 after it has been lifted. In use, when equipment, such as the stages 226 of the support decks 200 and/or the shaft enlargement arrangement 150, needs to be removed from the shaft 202, the mobile service deck 214 can be pulled up within/between the headgear arrangement 208, as indicated by outline 228. Once in this position, the mobile service deck 214 is out of the way, and thus does not need to be removed from the headgear arrangement 208. The lifting spreader bar 216 can now be used to fetch the relevant component or equipment item down in the shaft 202 and hoist it to surface 220 where it can be removed.

Figure 18C:
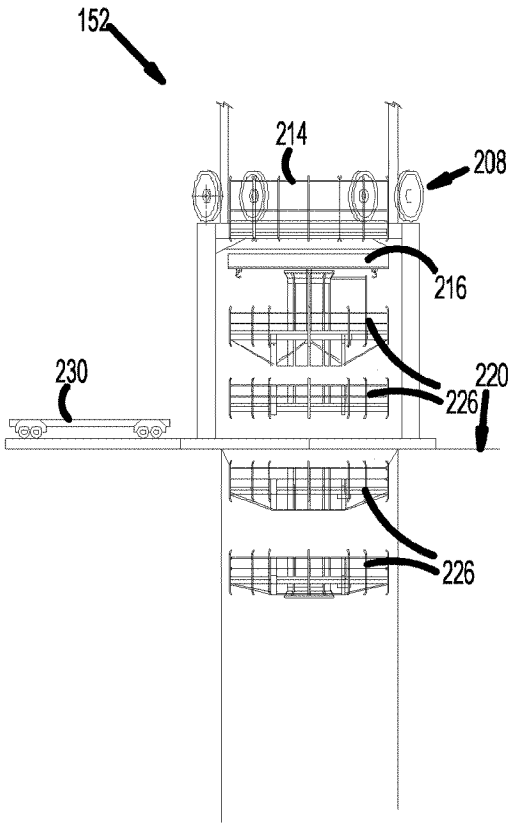
Figure 18B:
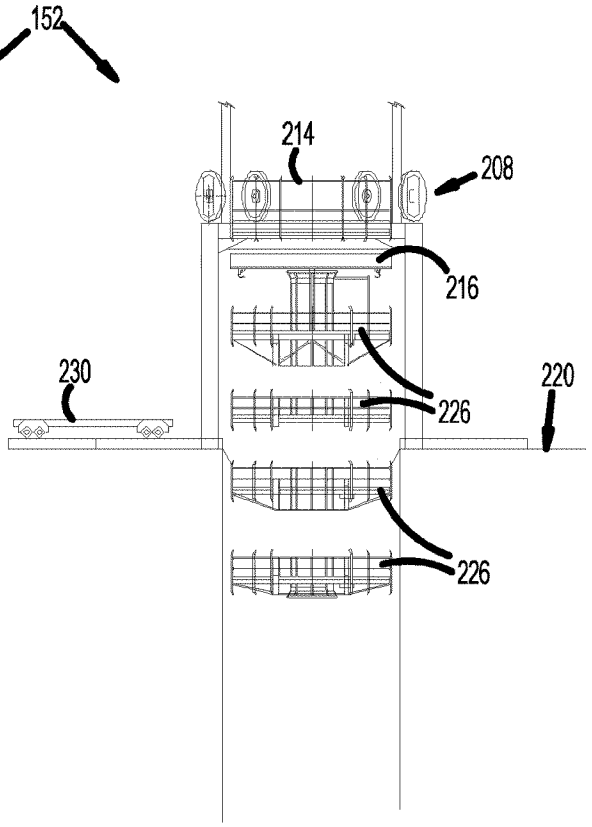
Figure 18A:
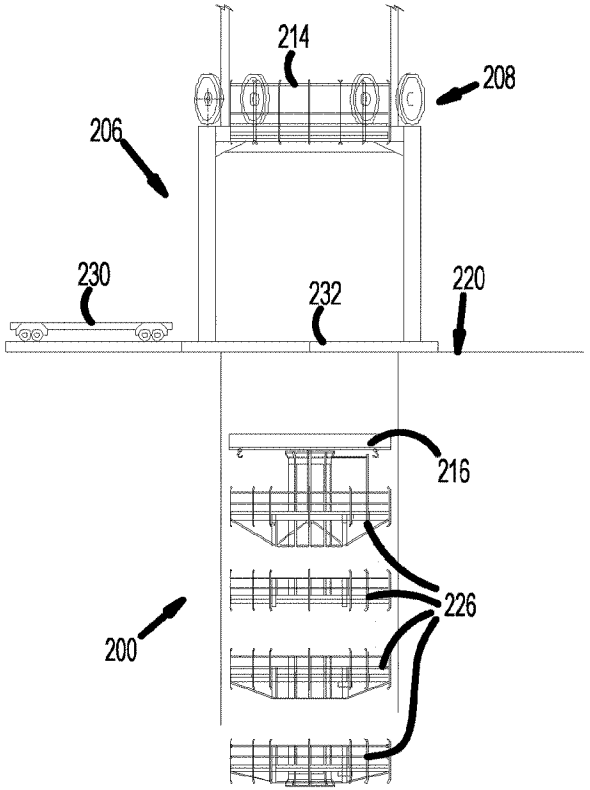
Figure 18F:
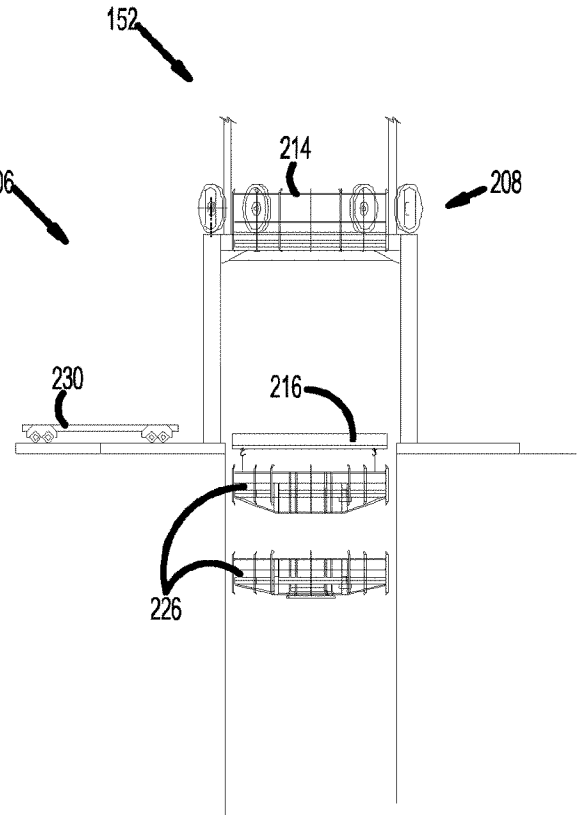
Figure 18E:
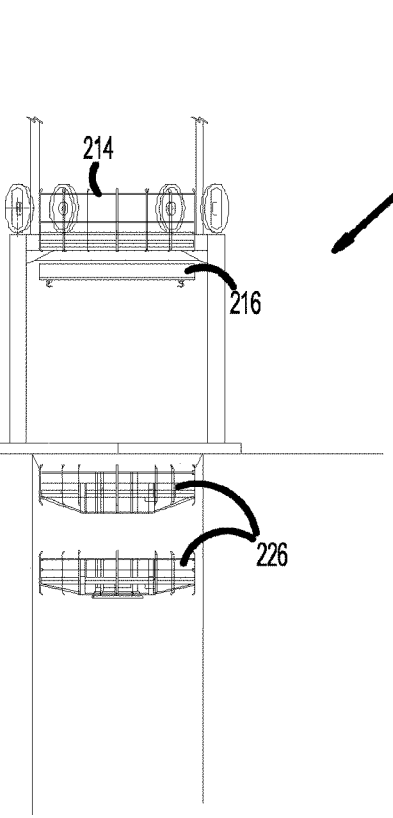
Figure 18D:
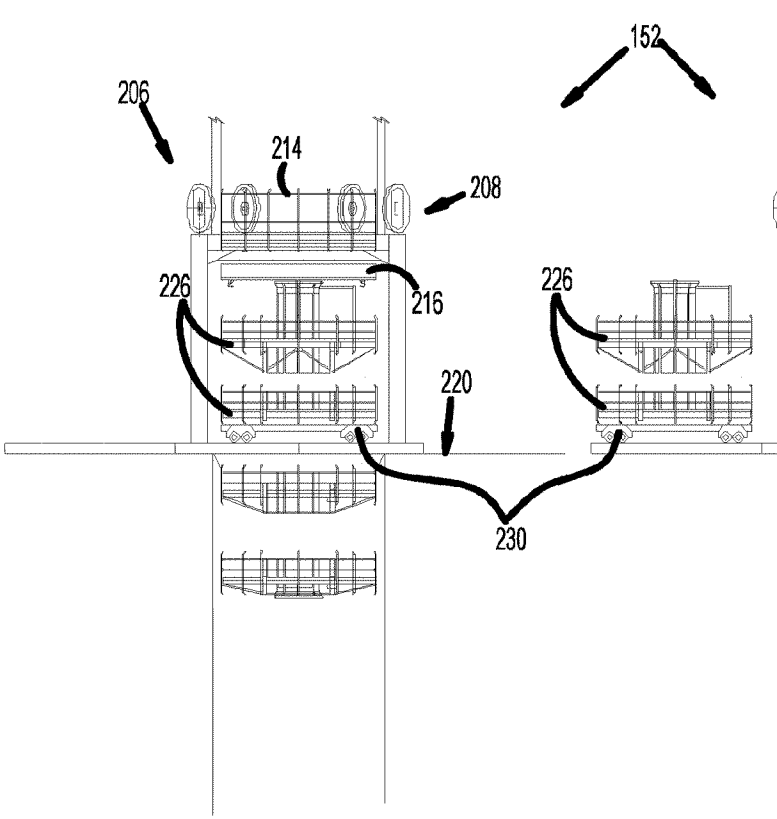
Figures 18G, 18H, 18I:
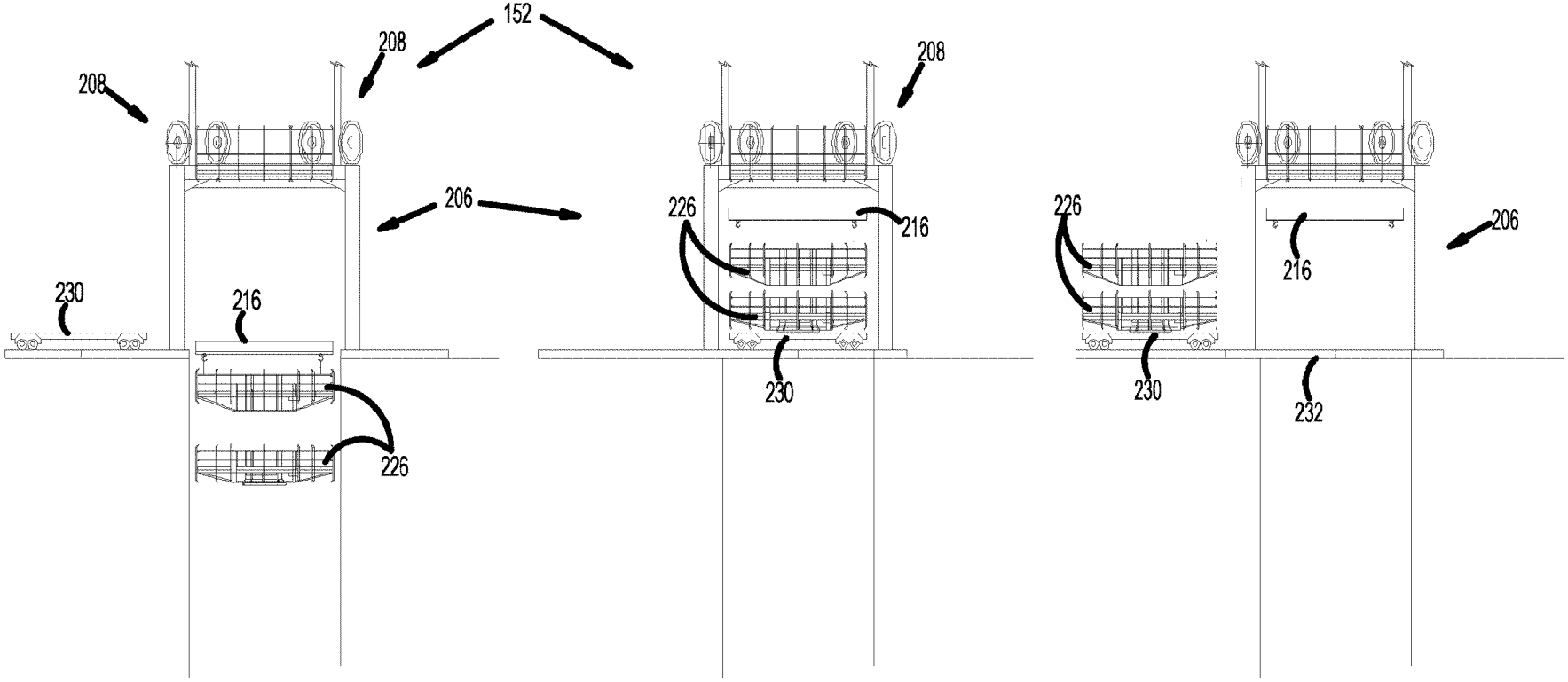

In use, with reference to FIG. 18, a carrying platform 230 may be provided with the top of the shaft typically being covered by a cover 232 (as shown in FIG. 18A). As indicated above, the mobile service deck 214 is lifted and out of the way. After the removal of the cover 232, the stages 226 of the support decks 200 may then be lifted using the headgear arrangement 208 in conjunction with the spreader bar 216, as shown in FIG. 18B. The cover 232 may then be replaced, to allow the platform 230 to move over the opening, as shown in FIG. 18C. The upper stages 226 may then be decoupled from the spreader bar 216, loaded onto the platform 230 and then moved away (FIGS. 18D and 18E). The spreader bar 216 may then be lowered and connected to the next stage/s 226 (FIG. 18F). The process is then simply repeated to enable the remaining stages 226 to be lifted and moved away.

Referring back to FIG. 16, to enable a level 240 extending away from the shaft 202 to be formed, the shaft enlargement arrangement 150 can be fully disconnected (or decoupled) from the rest of the boring system 152. A cover 242 is provided to cover the portion of the shaft 202 immediately above the disconnected shaft enlargement arrangement 150. The plurality of support decks 200 may then be lifted away from the disconnected shaft enlargement arrangement 150 to provide sufficient space for the formation of the breakaway level 240. Using explosives or suitable equipment 244, the breakaway 240 may be formed, and once formed, the cover 242 may be removed, and the shaft enlargement arrangement 150 may be reconnected to the rest of the boring system 152 to enable the shaft enlargement arrangement 150 to continue operating.

Figure 19:
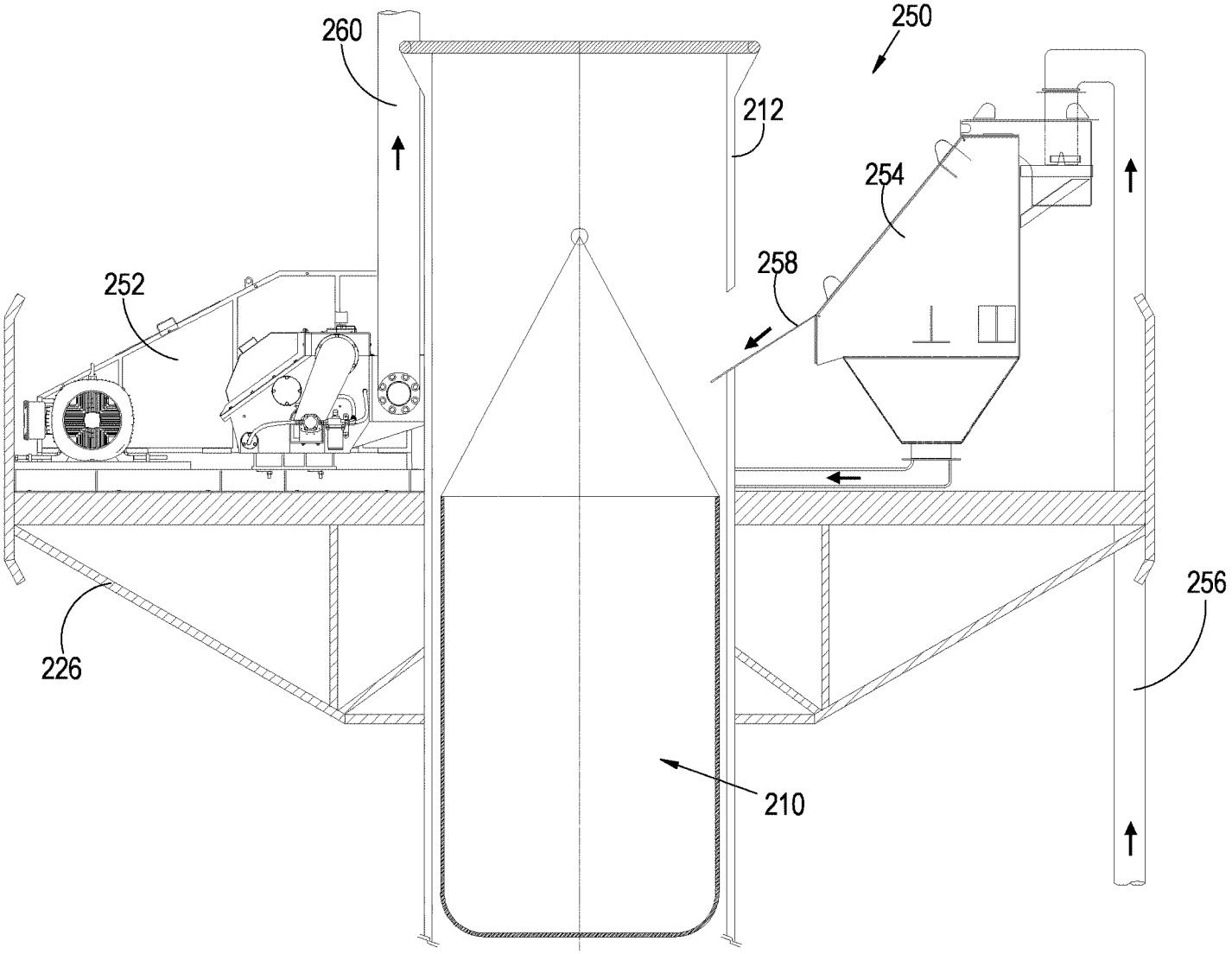
FIGS. 19 to 21 show various hoisting arrangements that may be fitted with one of the support decks.
Figure 20:
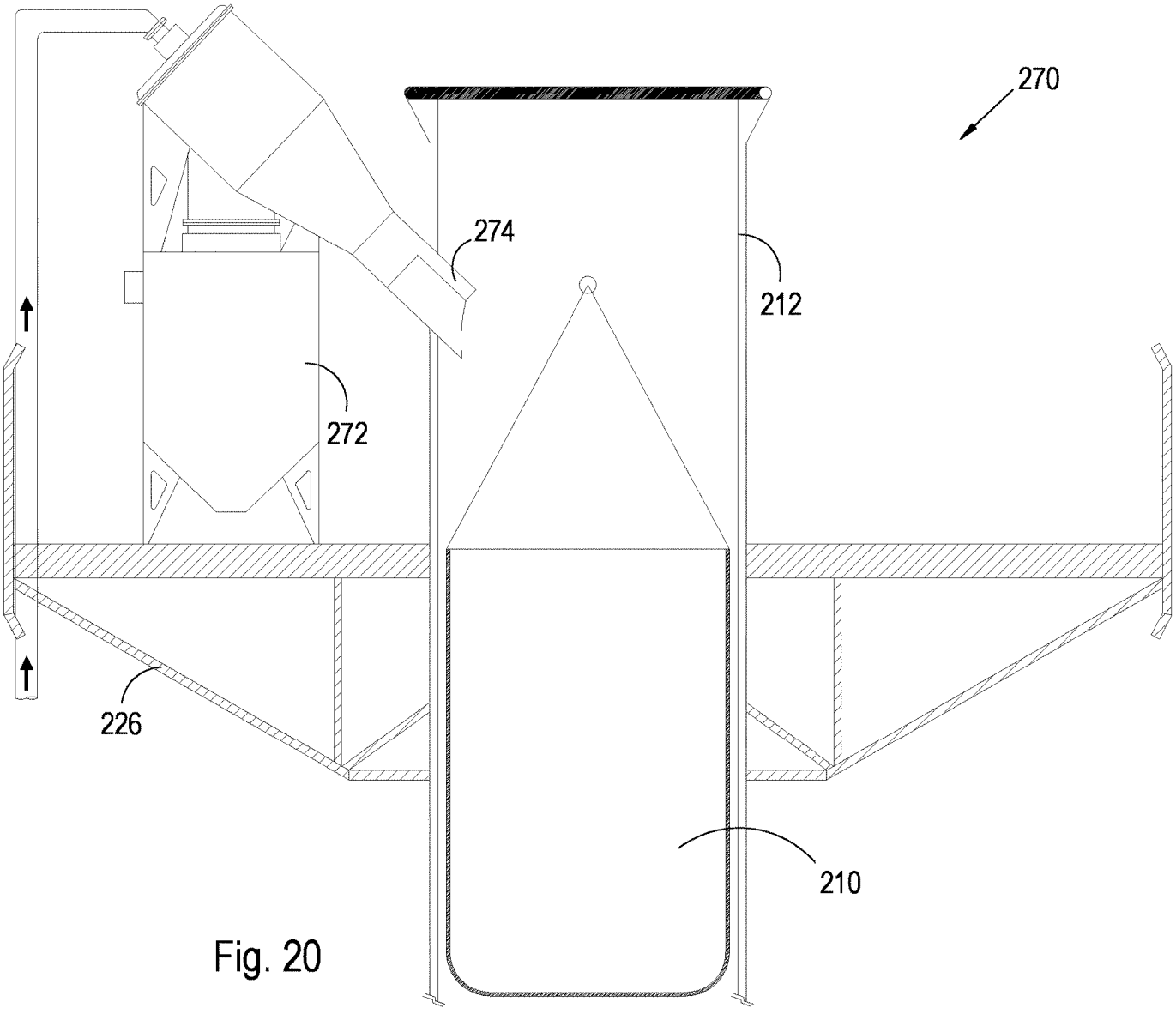
Figure 21:
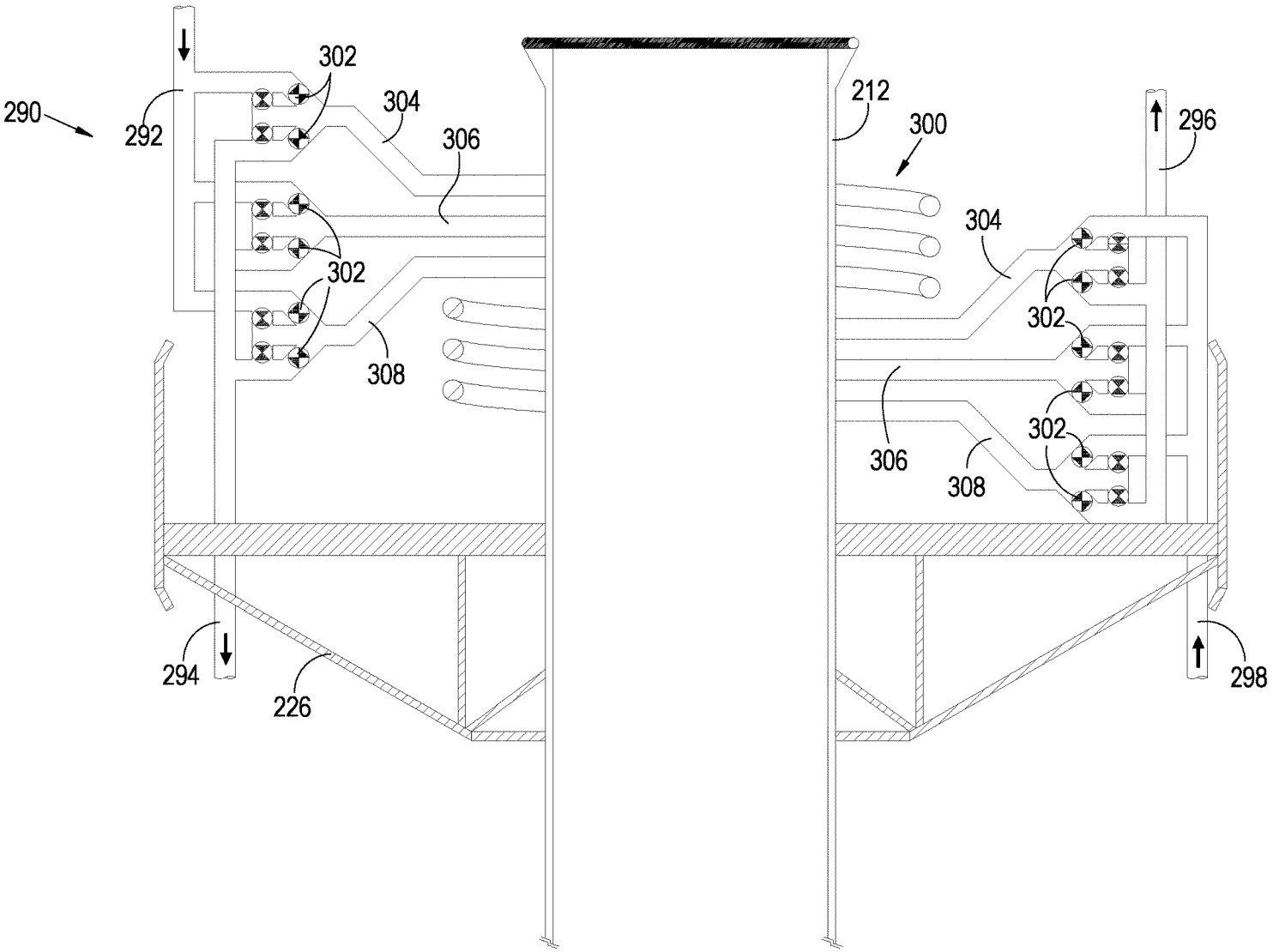

Turning now to FIGS. 19 to 21, one of the stages 226 of the support decks 200 comprises hoisting arrangements 250, 270 and 290, respectively.

In one version, as shown in FIG. 19, the hoisting arrangement 250 comprises a 'wet' hoisting arrangement 250. The hoisting arrangement 250 comprises a triplex pump 252 and a sieve bend 254, with the sieve bend 254 receiving slurry water pumped up through pipeline 256 by means of slurry pump 172 proximate the slurry cutting head. The slurry water is separated, with the more solid components/muck being discharged into the kibble 210 via a retractable chute 258, which may then be hoisted to surface with a kibble winder. The separated dirty water is then pumped with the triplex pump 252 through pipeline 260 where the fines will be removed from the water. Clean water may then be pumped back into the system.

In another version, as shown in FIG. 20, the hoisting arrangement 270 is a 'dry' hoisting arrangement. The hoisting arrangement 270 comprises a vacuum system to suck dry muck and cuttings into a vacuum tank 272, with the vacuum tank 272 then discharging the dry material via a retractable chute 274 into the kibble 210, which may then be hoisted up to surface. This arrangement is particularly useful in ground conditions where no water can be used, such as salt mines.

In yet another version, as shown in FIG. 21, the hoisting arrangement 290 is a 'hydraulic' hoisting arrangement. The hoisting arrangement 290 comprises a high pressure water pipe 292 to pump water from surface into the system 290, a low pressure surplus water pipe 294 to allow surplus water to flow back to a sump, a high pressure water pipe 296 which contains particles to be hoisted to surface, a low pressure incoming water pipe 298 with particles, and a multi-chamber arrangement 300 with valves 302 to regulate and control the flow of water through the water pipes. In use, while a first chamber 304 is waiting to be hoisted, a second chamber 306 is busy hoisting; while the second chamber 306 is hoisting through the high-pressure delivery system, a third chamber 308 is busy loading the particles. The surplus water will flow back to the sump via water pipe 294. All the valves 302 are actuated in a strictly controlled timing sequence to ensure a smooth flow through the system. The high pressure water which contains the particles will be hoisted to surface via the pipe 296. This system does not require a kibble, as all the particles generated while boring will be hoisted with this hydraulic hoisting system 290. This system 290 will all be fixed to one of the stages 226, as shown, and so as the shaft enlargement arrangement 150 advances, so does the hydraulic hoisting system 290, thus allowing continuous advancement.

Figure 22:
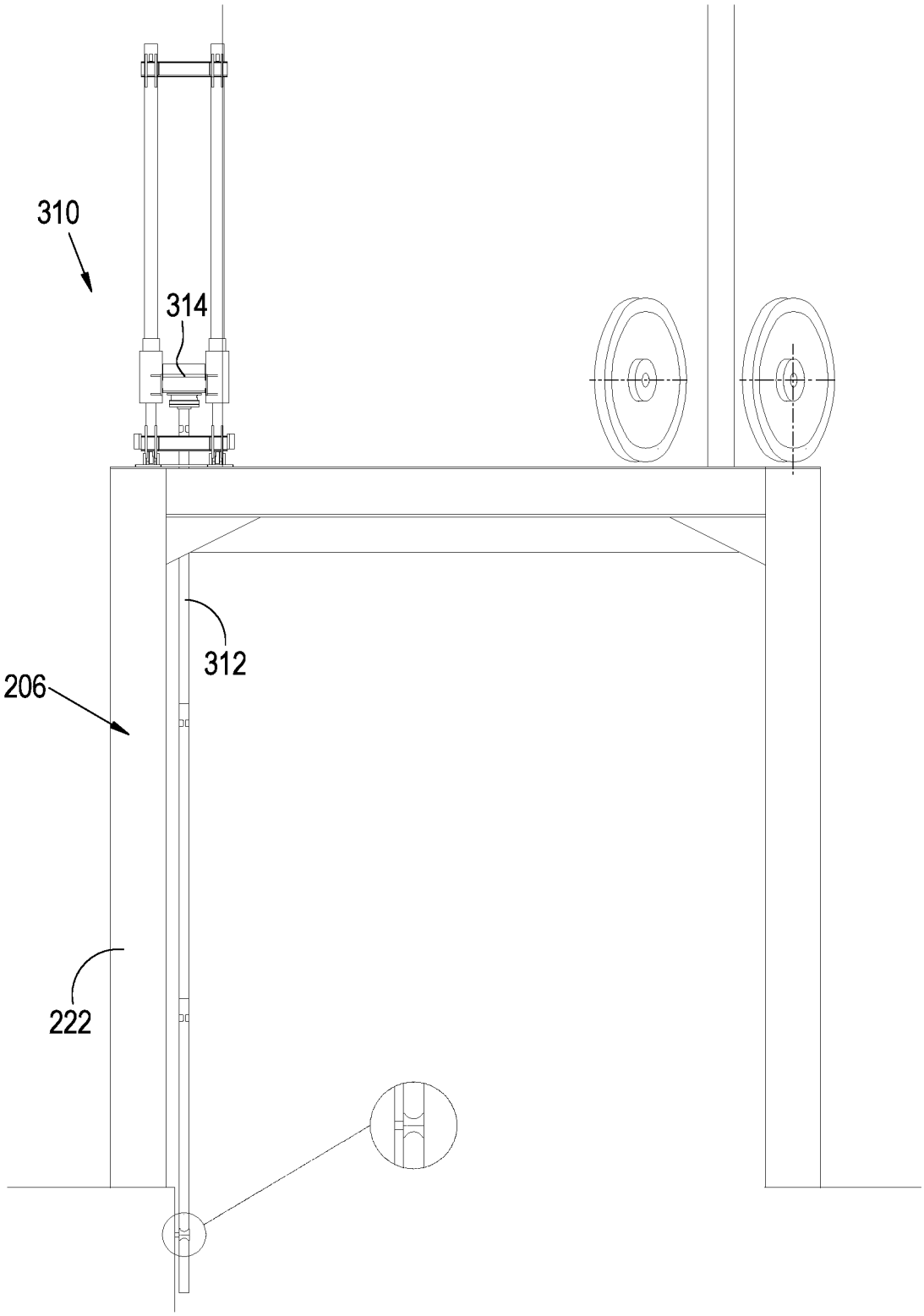
FIGS. 22 and 23 show a pipe handling arrangement that may be used in the boring system.
Figure 23:
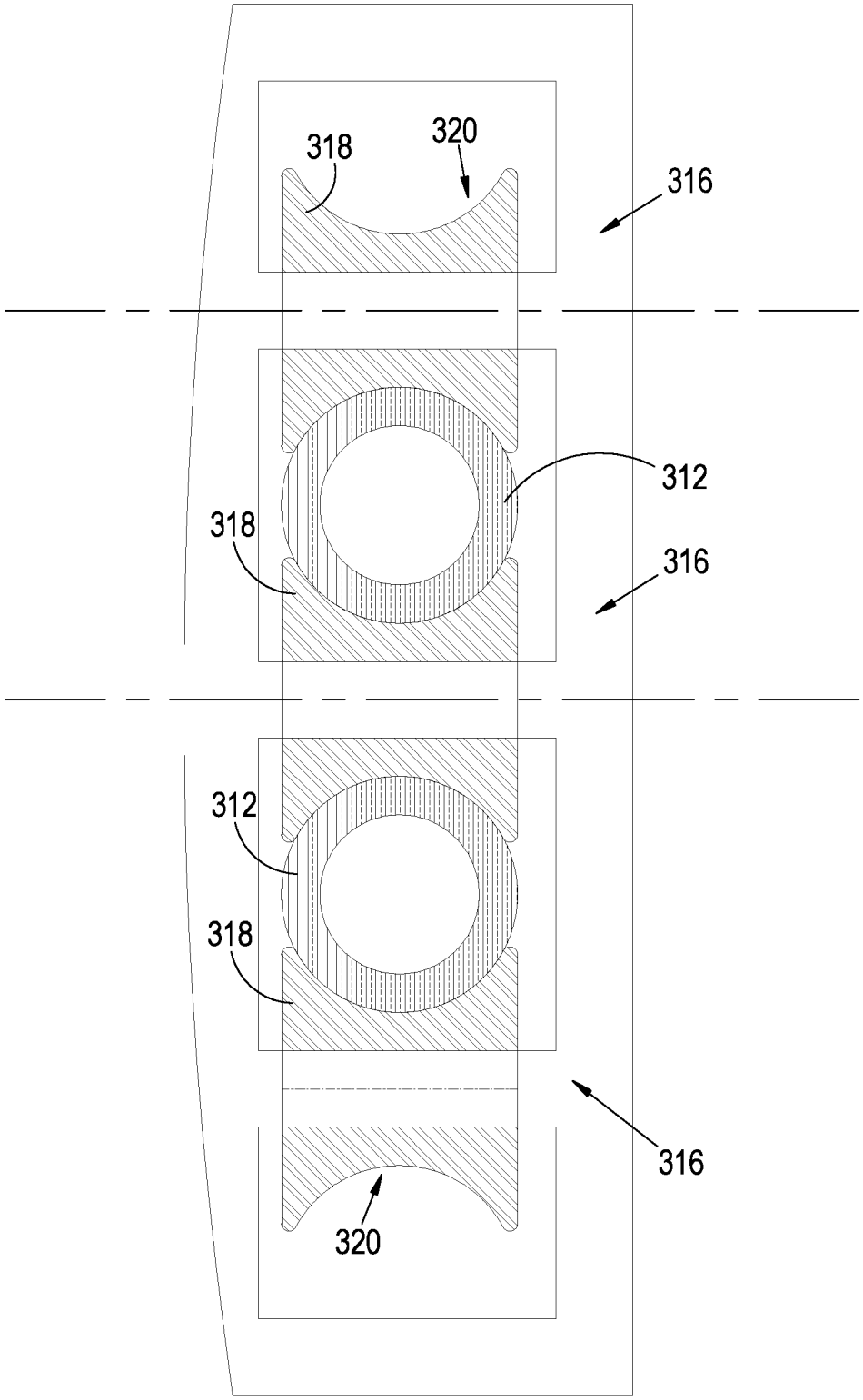

Turning now to FIGS. 22 and 23, the boring system 152 comprises a pipe handling arrangement 310, the pipes 312 typically comprising service pipes, such as water and ventilation pipes. The pipe handling arrangement 310 comprises an overhead rig 314, which may be fitted atop the overhead support assembly 206 to raise and lower at least one pipe 312 (but typically a plurality of pipes 312, as shown in FIG. 23. A guide means 316 is provided, comprising a plurality of rotatable rollers 318 that define a curved recess 320 for accommodating an outer rounded portion of the pipe 312. Thus as the pipes 312 are raised and lowered, a pair of adjacent rollers 318 accommodate the pipe 312 to guide the movement of the pipe therebetween.

The invention claimed is:

1. A shaft enlargement arrangement for a boring system, the shaft enlargement arrangement comprising:

a hollow column proximate a lower end of the boring system;

a reamer section comprising a downwardly tapering first cutter head arrangement that is rotatably fitted to the hollow column, with a first drive means being provided to rotate the first cutter head arrangement relative to the hollow column so as to bore downwardly a hole having a diameter corresponding substantially to a diameter of the first cutter head arrangement;

a boring head arrangement fitted to an operatively lower end of the enlargement arrangement, the boring head arrangement terminating in a downwardly tapering second cutter head arrangement to bore a leading or pilot hole having a diameter that is less than the diameter of the first cutter head arrangement as the boring system proceeds to bore downwardly, the second cutter head arrangement comprising a support body carrying a second winged arrangement, the support body being rotatable relative to a support housing from which it extends, the second winged arrangement comprising a plurality of wings fitted to the support body, each wing having an angled or transversely extending wing arm to which is fitted a plurality of second cutter elements or which comprises a plurality of second cutter elements, with a second drive means being provided to rotatingly drive the support body and the second cutter head arrangement, wherein actuator means are provided to move the wings relative to the support body, between an extended, operational V-shaped configuration to facilitate boring, and a collapsed, substantially aligned configuration to enable the second cutter head arrangement to be detached from the rest of the shaft enlargement arrangement and pulled up through the hollow column to surface;

a thrust section to allow the boring head arrangement to advance relative to the reamer section; and a gripper arrangement to secure the shaft enlargement arrangement within the bored hole and to control the advancing of the boring head arrangement relative to the reamer section.

2. The shaft enlargement arrangement of claim 1, wherein the first cutter head arrangement comprises a first cutter head support body carrying a first winged arrangement, the first cutter head support body being rotatably fitted around the hollow column, the first winged arrangement comprising a plurality of wings fitted to the first cutter head support body, each wing having an angled or transversely extending support beam to which is fitted a plurality of first cutter elements or that comprises a plurality of first cutter elements.

3. The shaft enlargement arrangement of claim 1, wherein the gripper arrangement is fitted to the hollow column, the gripper arrangement including a first series of circumferentially spaced gripper pads located between the first cutter head arrangement and the thrust section, and a second series of circumferentially spaced gripper pads located between the thrust section and the second cutter head arrangement.

4. The shaft enlargement arrangement of claim 1, wherein the boring head arrangement comprises a frusto-conical slurry boring head having a slurry pump, the slurry boring head comprising a tapering side wall terminating in an end face, the tapering side wall and/or the end face being fitted with the second cutter head arrangement to bore the leading hole as the boring system progresses downwardly.

5. The shaft enlargement arrangement of claim 4, wherein a section of the slurry boring head can be separated and removed from the slurry boring head, the removable section including at least the end face and the slurry pump.

6. The shaft enlargement arrangement of claim 4, wherein each of the second cutter elements comprising a working face from which a plurality of rows of buttons extend, the rows of buttons being arranged to limit the size of the cuttings to below a predetermined size.

7. A boring system including the shaft enlargement arrangement of claim 1 and a plurality of support decks configured to be locatable above the shaft enlargement arrangement within the hole bored by the first cutter head arrangement with the shaft enlargement arrangement being separable from the rest of the boring system.

8. The boring system of claim 7, further including an aboveground support rig arrangement comprising an overhead support assembly and a headgear arrangement to lift and lower the shaft enlargement arrangement and the plurality of support decks.

9. The shaft enlargement arrangement of claim 1, wherein at least one collecting channel is defined in the hollow column, below the first cutter head arrangement, into which cuttings produced by the rotating first cutter head arrangement can be collected, the at least one collecting channel defining an inlet to receive the cuttings and an outlet through which the cuttings can exit the channel into the hollow column, with a downwardly angled passageway being provided between the inlet and outlet to facilitate the passage of the cuttings into the hollow column under the influence of gravity for subsequent collection by a kibble travelling up and down the hollow column.

10. The boring system of claim 8, wherein a mobile service deck is provided above the plurality of support decks, to which a spreader bar is connected or connectable, wherein the mobile service deck is configured to be lifted, separated and temporarily accommodated between the headgear arrangement, to enable the spreader bar to be used to fetch a component or item within a shaft of the hole and hoist it to surface.

11. The boring system of claim 7, wherein one of the support decks comprises a hoisting arrangement, the hoisting arrangement comprising a pump and a sieve bend, with the sieve bend receiving slurry water pumped up through a pipeline by means of a slurry pump proximate a slurry cutting head, the slurry water then being separated with more solid components/muck resulting from the separation being discharged into a kibble via a retractable chute.

12. The boring system of claim 7, wherein one of the support decks comprises a hoisting arrangement, the hoisting arrangement comprising a vacuum system to suck dry muck and cuttings into a vacuum tank, with the vacuum tank then discharging the dry muck and cuttings via a retractable chute into a kibble, which may then be hoisted up to surface.

13. The boring system of claim 7, wherein one of the support decks comprises a hoisting arrangement, the hoisting arrangement comprising:

a high pressure water pipe to pump water from surface into the boring system;

a low pressure surplus water pipe to allow surplus water to flow back to a sump;

a second high pressure water pipe configured to contain particles to be hoisted to surface;

a low pressure incoming water pipe configured to contain particles; and a multi-chamber arrangement with valves to regulate and control flow of water through the water pipes.

14. A boring system comprising the shaft enlargement arrangement of claim 1 and a pipe handling arrangement, the pipe handling arrangement comprising an overhead rig to raise and lower at least one pipe, and a guide means comprising a plurality of rotatable rollers that define a curved recess for accommodating an outer rounded portion of the at least one pipe, so that as the at least one pipes is raised and lowered, a pair of adjacent rollers accommodate the at least one pipe to guide the movement of the at least one pipe therebetween.

15. A boring system comprising:

a shaft enlargement arrangement comprising:

a hollow column proximate a lower end of the boring system;

a reamer section comprising a downwardly tapering first cutter head arrangement that is rotatably fitted to the hollow column, with first drive means being provided to rotate the first cutter head arrangement relative to the hollow column so as to bore downwardly a hole having a diameter corresponding substantially to a diameter of the first cutter head arrangement;

a boring head arrangement fitted to an operatively lower end of the enlargement arrangement, the boring head arrangement terminating in a downwardly tapering second cutter head arrangement to bore a leading or pilot hole having a diameter that is less than the diameter of the first cutter head arrangement as the boring system proceeds to bore downwardly;

a thrust section to allow the boring head arrangement to advance relative to the reamer section; and a gripper arrangement to secure the shaft enlargement arrangement within the bored hole and to control the advancing of the boring head arrangement relative to the reamer section;

a plurality of support decks configured to be locatable above the shaft enlargement arrangement within the hole bored by the first cutter head arrangement with the shaft enlargement arrangement being separable from the rest of the boring system;

an aboveground support rig arrangement comprising an overhead support assembly and a headgear arrangement to lift and lower the shaft enlargement arrangement and the plurality of support decks; and a mobile service deck configured to be locatable above the plurality of support decks and to which a spreader bar is connected or connectable, wherein the mobile service deck is configured to be lifted, separated and temporarily accommodated between the headgear arrangement, to enable the spreader bar to be used to fetch a component or item within a shaft of the hole and hoist it to surface.

16. The boring system of claim 15, wherein one of the support decks comprises a hoisting arrangement, the hoisting arrangement comprising:

a pump and a sieve bend, with the sieve bend configured to receive slurry water pumped up through a pipeline by means of a slurry pump proximate a slurry cutting head, the slurry water then being separated with more solid components/muck resulting from separation being discharged into a kibble via a retractable chute; or a vacuum system to suck dry muck and cuttings into a vacuum tank, with the vacuum tank then discharging the dry muck and cuttings via a retractable chute into a kibble, which may then be hoisted up to surface.

17. The boring system of claim 15, further comprising a pipe handling arrangement, the pipe handling arrangement comprising an overhead rig to raise and lower at least one pipe, and a guide means comprising a plurality of rotatable rollers that define a curved recess for accommodating an outer rounded portion of the at least one pipe, so that as the at least one pipe is raised and lowered, a pair of adjacent rollers accommodate the at least one pipe to guide the movement of the at least one pipe therebetween.

18. A boring system comprising:

a shaft enlargement arrangement comprising:

a hollow column proximate a lower end of the boring system;

a reamer section comprising a downwardly tapering first cutter head arrangement that is rotatably fitted to the hollow column, with first drive means being provided to rotate the first cutter head arrangement relative to the hollow column so as to bore downwardly a hole having a diameter corresponding substantially to a diameter of the first cutter head arrangement;

a boring head arrangement fitted to an operatively lower end of the shaft enlargement arrangement, the boring head arrangement terminating in a downwardly tapering second cutter head arrangement to bore a leading or pilot hole having a diameter that is less than the diameter of the first cutter head arrangement as the boring system proceeds to bore downwardly;

a thrust section to allow the boring head arrangement to advance relative to the reamer section; and a gripper arrangement to secure the shaft enlargement arrangement within the bored hole and to control the advancing of the boring head arrangement relative to the reamer section; and a plurality of support decks locatable above the shaft enlargement arrangement within the hole bored by the first cutter head arrangement, with the shaft enlargement arrangement being separable from the rest of the boring system, wherein one of the support decks comprises a hoisting arrangement, the hoisting arrangement comprising a vacuum system to suck dry muck and cuttings into a vacuum tank, with the vacuum tank then discharging the dry muck and cuttings via a retractable chute into a kibble, which may then be hoisted up to surface.

19. The boring system claim 18, further comprising an aboveground support rig arrangement comprising an overhead support assembly and a headgear arrangement to lift and lower the shaft enlargement arrangement and the plurality of support decks, wherein a mobile service deck is provided above the plurality of support decks, to which a spreader bar is connected or connectable, wherein the mobile service deck can be lifted, separated and temporarily accommodated between the headgear arrangement, to enable the spreader bar to be used to fetch a component or item within a shaft of the hole and hoist it to surface.

20. The boring system of claim 18, further comprising a pipe handling arrangement, the pipe handling arrangement comprising an overhead rig to raise and lower at least one pipe, and a guide means comprising a plurality of rotatable rollers that define a curved recess for accommodating an outer rounded portion of the at least one pipe, so that as the at least one pipes is raised and lowered, a pair of adjacent rollers accommodate the at least one pipe to guide the movement of the at least one pipe therebetween.

* * * * *